US008180251B2

(12) United States Patent
Nakamura et al.

(10) Patent No.: US 8,180,251 B2
(45) Date of Patent: May 15, 2012

(54) COVER AND CARTRIDGE

(75) Inventors: Yuuki Nakamura, Mishima (JP); Yoshifumi Takeyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/912,016

(22) Filed: Oct. 26, 2010

(65) Prior Publication Data

US 2011/0103830 A1 May 5, 2011

(30) Foreign Application Priority Data

Oct. 30, 2009 (JP) ..... 2009-250059

(51) Int. Cl.

| | |
|---|---|
| ***G03G 21/18*** | (2006.01) |
| ***G03G 15/02*** | (2006.01) |
| ***G03G 15/08*** | (2006.01) |
| ***G03G 15/00*** | (2006.01) |

(52) U.S. Cl. ..... 399/115; 399/114; 399/116; 399/234; 399/411

(58) Field of Classification Search ..... 399/114–117, 399/234, 411

See application file for complete search history.

(56) References Cited

U.S. PATENT DOCUMENTS

| | | | | |
|---|---|---|---|---|
| 6,002,896 | A * | 12/1999 | Miyamoto et al. | 399/114 |
| 6,665,507 | B1 * | 12/2003 | Hooper et al. | 399/110 |
| 2008/0292331 | A1 | 11/2008 | Yokomori et al. | |
| 2010/0054796 | A1 | 3/2010 | Nakamura et al. | |
| 2010/0054799 | A1 | 3/2010 | Nakamura et al. | |
| 2010/0054804 | A1 | 3/2010 | Uneme et al. | |
| 2010/0054807 | A1 | 3/2010 | Takeyama et al. | |

FOREIGN PATENT DOCUMENTS

| | | |
|---|---|---|
| JP | 2000-181328 | 6/2000 |

* cited by examiner

*Primary Examiner* — David Gray
*Assistant Examiner* — Joseph S Wong
(74) *Attorney, Agent, or Firm* — Fitzpatrick, Cella, Harper & Scinto

(57) ABSTRACT

An electrophotographic image forming apparatus detachably mountable to a main assembly of the apparatus, includes a rotatable image bearing member on which a latent image is to be formed; charging means for contacting said image bearing member to charge a surface of said image bearing member; a frame supporting said image bearing member and said charging means; a covering member, demountably mounted to said frame, for protecting the surface of said image bearing member; and a spacer member including a spacing portion, movably provided on said covering member, for entering between said image bearing member and said charging means to space them therebetween, and a retaining portion, contacting said covering member when said spacing portion is not between said image bearing member and said charging means, for preventing said spacer member from disengaging from said covering member.

13 Claims, 18 Drawing Sheets

(a)

(b)

(a)

(b)

COVER AND CARTRIDGE

FIELD OF THE INVENTION AND RELATED ART

The present invention relates to a cover and a cartridge.

A "drum cartridge" means a cartridge which comprises an integral combination of at least a charging means and an image bearing member, and also, is removably mountable in the main assembly of an electrophotographic image forming apparatus. A "cover" means a drum cartridge component which is removably attachable to the main assembly of a brand-new drum cartridge to protect the image bearing member of the cartridge during the commercial distribution of the drum cartridge.

An electrophotographic image forming apparatus is an apparatus which electrophotographically forms an image on recording medium. For example, it includes an electrophotographic copying machine, an electrophotographic printer (laser printer, LED printer, and the like), a facsimile apparatus, a word processor, a multifunction image forming apparatus capable of performing two or more functions of the preceding apparatuses, and the like. Hereafter, an "apparatus main assembly" means an electrophotographic image forming apparatus minus a drum cartridge (drum cartridges) which is removably mountable in the image forming apparatus main assembly.

An electrophotographic image forming apparatus (which hereafter may be referred to simply as image forming apparatus or apparatus) forms an electrostatic latent image on its image bearing member (electrophotographic photosensitive member), and develops the electrostatic latent image into a visible image, with the use of its developing means. In the field of an electrophotographic image forming apparatus, it has been common practice to employ the so-called drum cartridge system, which integrally places at least a charging means and an image bearing member in a cartridge so that they can be removably mountable in the main assembly of an image forming apparatus. Generally, it is a photosensitive drum (which hereafter will be referred to simply as drum) that is used as an image bearing member. The drum cartridge system enables an average user to maintain an electrophotographic image forming apparatus by him- or herself, that is, without relying on a professional service person. Thus, it can drastically improve an image forming apparatus in operability. Therefore, the drum cartridge system is widely used in the field of an image forming apparatus.

A drum cartridge (which hereafter may be referred to simply as cartridge) has: a drum; a charging means for charging the drum; and a frame (drum cartridge frame) by which the drum and charging means are supported. One of the charging means employed by an image forming apparatus is a contact charging means, which is kept in contact with the peripheral surface of a drum while the surface is charged by the charging means. In the case of this type of charging means, a roller is used as a charging means. The charging means is supported by the cartridge frame in such a manner that it is kept pressed upon the peripheral surface of the drum in order to ensure that it remains in contact with the peripheral surface of the drum. Thus, if the image forming apparatus is left unused for a substantial length of time, it is possible that the charge roller will deform. Thus, in order to prevent this type of deformation of the charge roller, not only must the materials for a charge roller to be carefully selected, but also, the condition under which charge rollers are manufactured has to be strictly controlled, which is problematic from the standpoint of efficient cartridge manufacture.

One of the solutions to the above described problem is a structural arrangement for a cartridge that keeps the charge roller and drum in the cartridge separated from each other until the cartridge is used for the first time, that is, until the cartridge reaches a user, in particular, during the commercial shipment of the cartridge (Japanese Laid-open Patent Application 2000-181328). In the case of this structural arrangement, a brand-new cartridge is provided with a cover for protecting the drum in the cartridge, in particular, during the commercial shipment of the cartridge, and a cover anchoring member for keeping the cover anchored to the cartridge by being put through the cover. The anchoring member is inserted between the charge roller and drum, to separate, and keep separated, the charge roller and drum from each other when the cartridge is shipped out to retailers or a user.

According the prior arts, the cover for protecting the drum during the commercial shipment of a cartridge is physically independent from a separating member (spacer) for separating the charge roller and drum from each other prior to its shipment, and keeping them separated during the shipment. Thus, when a user uses the cartridge for the first time, the user has to remove both the cover and spacer, independently from each other. In other words, this structural setup adds to the workload of the user. Thus, it was proposed to integrally form the cover and spacer so that the removal of the cover by a user automatically allows the charge roller to be placed in contact with the drum. More concretely, it is possible to integrally form the cover and spacer so that the resultant combination of cover and spacer looks as if the spacer projects from the cover. With the combination formed as described above, the charge roller and drum can be separated, and kept separated, from each other, by the insertion of the spacer portion of the combination between the charge roller and drum.

This structural arrangement, however, has the following problem. That is, when a user attaches the cover-spacer to a cartridge, the spacer portion of the cover-spacer has to be very accurately inserted between the charge roller and drum. If the spacer portion fails to be accurately inserted, the spacer portion comes into contact with the portions of the main assembly of the cartridge other than the interface between the image bearing member and charging member, which in turn interferes with the operation carried out by a user to attach (reattach) the cover to the cartridge frame. In other words, the integration of the cover and spacer reduces the cover-spacer in usability, the efficiency with which the cover and spacer can be attached to the cartridge. Further, the interference of the spacer portion with the operation to attach the cover portion to the cartridge causes the cover portion to loosely fit with the cartridge, preventing thereby the cover portion from protecting the drum.

The case in which a cartridge is desired to be fitted with the cover and spacer includes a case where a used cartridge is stored outside the main assembly for a substantial length of time, a case where a used-up cartridge is shipped as a recyclable cartridge to a recycle station or the like, for example. It is also possible for a used-up cartridge to fail to properly fit in a cartridge recycle box (box dedicated to recycling of cartridge), and therefore, to be discard as a piece of trash. If a used-up cartridge is shipped without being fitted with a cover-spacer, its drum is not protected during the shipment, and therefore, it may become impossible to recycle the cartridge. One of the solutions to this problem is to increases a drum recycle box in size, which, however, reduces the cartridge recycling in transportation efficiency.

SUMMARY OF THE INVENTION

Thus, the primary object of the present invention is to provide a combination of a cover, a spacer, and a cartridge main assembly, which allows the charging means and image bearing member of the cartridge to be placed in contact with each other by the removal of the cover from the cartridge. Another object of the present invention is to provide a combination of a cartridge, a cover therefor, and a spacer therefor, which prevents the spacer from interfering with the reattachment of the cover to the cartridge.

According to an aspect of the present invention, there is provided an electrophotographic image forming apparatus detachably mountable to a main assembly of the apparatus, comprising (i) a rotatable image bearing member on which a latent image is to be formed; (ii) charging means for contacting said image bearing member to charge a surface of said image bearing member; (iii) a frame supporting said image bearing member and said charging means; (iv) a covering member, demountably mounted to said frame, for protecting the surface of said image bearing member; and (v) a spacer member including a spacing portion, movably provided on said covering member, for entering between said image bearing member and said charging means to space them therebetween, and a retaining portion, contacting said covering member when said spacing portion is not between said image bearing member and said charging means, for preventing said spacer member from disengaging from said covering member.

According to another aspect of the present invention, there is provided a cover member usable with an electrophotographic image forming apparatus, wherein the electrophotographic image forming apparatus includes a rotatable image bearing member on which a latent image is to be formed; charging means for contacting said image bearing member to charge a surface of said image bearing member; a frame supporting said image bearing member and said charging means, said covering member being mountable to the frame, a covering member comprising a spacer member including a spacing portion, movably provided on said covering member, for entering between said image bearing member and said charging means to space them therebetween, and a retaining portion, contacting said covering member when said spacing portion is not between said image bearing member and said charging means, for preventing said spacer member from disengaging from said covering member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 12(*b*) and 12(C) are schematic cross-sectional views of the combination of the drum cover and drum spacer.

DETAILED DESCRIPTION OF THE PREFERRED EMBODIMENTS

Embodiment

General Structure of Image Forming Apparatus

Figure 3:
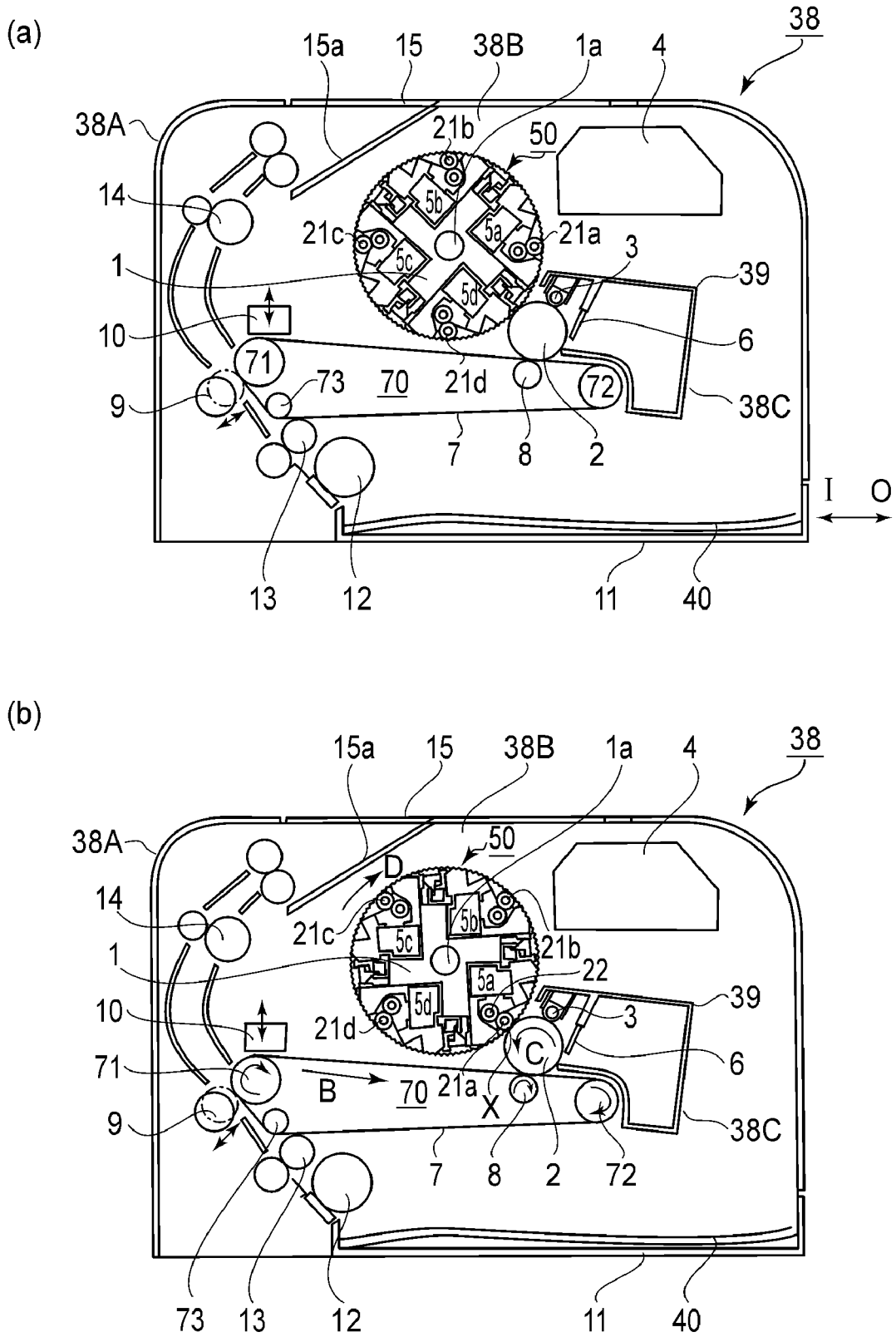
FIGS. 3(*a*) and 3(*b*) are schematic sectional views of the electrophotographic image forming apparatus in the first embodiment, at a vertical plane perpendicular to the recording medium conveyance direction.

FIGS. 3(*a*), 3(*b*), and 4(*a*) are schematic cross-sectional views of the electrophotographic image forming apparatus 38 in this embodiment, at a vertical plane perpendicular to the recording medium conveyance direction, and show the general structure of the apparatus. The apparatus 38 is a full-color laser beam printer which uses one of the electrophotographic processes. It is based on four primary colors. It can form a color image on a sheet of recording medium (which hereafter may be referred to simply as sheet) in response to the electrical signals inputted into the control circuit (unshown) from a host apparatus (unshown), such as a personal computer, an image reader, a facsimile (on transmitting side), etc. The control circuit (controlling means: CPU) exchanges various electrical information with a host apparatus and/or the control panel (unshown) of the image forming apparatus, and also, integrally controls the image forming operation of the apparatus 38 following preset control programs and referential tables. In other words, the image forming operation of the apparatus 38, which is described next, is controlled by the control circuit.

The apparatus 38 has a photosensitive drum 2 as an image bearing member. It has also: a charging means 3 for uniformly charging the peripheral surface of the drum 2; an exposing means for forming an electrostatic latent image on the peripheral surface of the drum 2 by projecting a beam of laser light upon the charged portion of the peripheral surface of the drum 2 in a manner of scanning the portion; and a development assembly 50. The assembly 50 has multiple developing means 5 (5*a*, 5*b*, 5*c*, and 5*d*) for developing electrostatic latent images on the drums 2 into multiple visible images, one for one, with the use of developer (toner). The apparatus 38 has also a rotary 1, which is a roughly cylindrical developing means positioning rotatable mechanism, and has multiple (four in this embodiment) developing means chambers into which the multiple developing means 5, more specifically, yellow (Y), magenta (M), cyan (C), and black (K) developing cartridges 5*a*, 5*b*, 5*c*, and 5*d* are removably mountable, one for one. The multiple developing means chambers are the same in size, being roughly 90° in terms of the rotational direction of the rotary 1. The rotary 1 is rotatably supported by the frame 38B of the main assembly of the apparatus 38. The yellow (Y), magenta (M), cyan (C), and black (K) developing cartridges 5*a*, 5*b*, 5*c*, and 5*d* are developing devices which contains yellow, magenta, cyan, and black toners, one for one. Further, the apparatus 38 has a cleaning means 6 for removing the toner remaining on the peripheral surface of the drum 2.

In this embodiment, the drum 2, charging means 3, and cleaning means 6 are integral parts of the drum cartridge 39, which is removably mountable into one of the cartridge chambers 38C in the apparatus main assembly 38A, which is what remains after the removal of the drum cartridges 39 from the electrophotographic image forming apparatus.

The apparatus 38 has also an intermediary transfer belt unit 70, which is under the rotary 1. The unit 70 has a flexible and endless intermediary transfer belt 7 which is suspended, and kept stretched, by four rollers 71, 72, 73, and 8. The roller 71 is in the rear portion of the main assembly 38A, and opposes the second transfer roller 9, with the presence of the intermediary transfer belt 7 between itself and second transfer roller 9. The roller 72 is the belt driving roller. The roller 73 is a tension roller for providing the intermediary transfer belt 7 with a proper amount of tension. The roller 8 is the first transfer roller which opposes the drum 2. More specifically, it is kept pressed against the portion of the peripheral surface of the drum 2, which is facing the belt 7. Further, the apparatus 38 has a cassette 11, which is below the unit 70, and in which sheets 40 of recording medium are stored in layers. The cassette 11 is inserted into, or removed from, the apparatus 38, from the front side of the apparatus 38 (front loading).

The color image forming operation carried out by the apparatus 38 to form a color image on the sheet 40 of recording medium (which hereafter may be referred to simply as sheet 40) is as follows: FIG. 3(*a*) shows the apparatus 30 which is on standby. As an image formation start signal is inputted into the apparatus 38, the control circuit rotates the drum 2 in the direction indicated by an arrow mark C, in synchronism with the circularly movement of the belt 7 indicated by an arrow mark B, as shown in FIG. 3(*b*). The peripheral velocity of the drum 2 is virtually the same as the circular movement of the belt 7. Then, the peripheral surface of the drum 2 is uniformly charged by the charging means 3 to preset polarity and potential level. Then, the uniformly charged portion of the peripheral surface of the drum 2 is exposed by the exposing means 4; the uniformly charged portion of the peripheral surface of the drum 2 is scanned with a beam of light emitted by the exposing means 4 in response to the electric signals generated according to the information of yellow (Y) component of the image to be formed. As a result, an electrostatic latent image, which corresponds to the yellow (Y) component of the image to be formed is formed.

Further, the control circuit activates the rotary driving mechanism (unshown) to rotate the rotary 1 about its rotational axle 1*a* in the direction indicated by an arrow mark D, in synchronism with the progression of the image forming operation (formation of electrostatic latent image corresponding to yellow (Y) color component). The control circuit stops the rotation of the rotary 1 with such a timing that the development roller 21*a* in the yellow development cartridge 5*a*, that is, the roller for supplying the peripheral surface of the drum 2 with the yellow developer, will be positioned in the development position X, in which the development roller 21*a* directly opposes the peripheral surface of the drum 2. With the yellow development cartridge 5*a* being positioned as described above, the development roller 21*a* in the yellow development cartridge 5*a*, and the toner supply roller 22 in the cartridge 5*a*, which is the member for supplying the development roller 21*a* with yellow toner, are rotated while a preset development bias is applied to the roller 21*a*. The roller 21*a* is made different in potential level from the drum 2 so that the yellow toner adheres to the drum 2 in the pattern of the electrostatic latent image on the drum 2. In other words, the electrostatic latent image on the drum 2 is developed into a visible image (yellow toner image) by depositing the yellow toner to the drum 2 in the pattern of the latent image. Further, to the first transfer roller 8, a preset first transfer bias (voltage), which is opposite in polarity to the toner charge polarity, is applied, whereby the monochromatic yellow (Y) toner image is transferred (first transfer), as if being peeled away from the drum 2, onto the belt 7, which is being circularly moved.

As the first transfer of the yellow (Y) toner image, that is, the transfer of the yellow (Y) toner image from the drum 2 onto the belt 71, ends, the control circuit rotates the rotary 1 so that the development cartridge, which is to be used next will be placed in the development position X. That is, the control circuit rotates the rotary 1 so that the yellow (Y), magenta (M), cyan (C), and black (K) development cartridges 5*a*, 5*b*, 5*c*, and 5*d* are sequentially placed in the development position X, where each development cartridge directly opposes the drum 2. Then, the process similar to the above described process for forming the monochromatic yellow (Y) image, is repeated to form an electrostatic latent image for each of the magenta (M), cyan (C), and black (K) color components of the image to be formed. Then, the three electrostatic latent images are sequentially developed, and the resultant three monochromatic images, different in color, are sequentially transferred (first transfer) in layers onto the yellow (Y) toner image on the belt 7. Consequently, a full-color toner image synthetically emerges from the layered four monochromatic toner images, that is, the yellow (Y), magenta (M), cyan (C), and black (K) toner monochromatic images.

While a full-color toner image is formed on the circularly moving belt 7 as described above, the second transfer roller 9, which is to be pressed against the roller 71 which functions as a belt backing roller, is kept in a preset position in which the transfer roller 9 is kept separated from the belt 7, as indicated by a solid line in FIG. 3(*b*). Further, the cleaning unit 10, which is for cleaning the belt 7, is also kept in a preset position in which there is no contact between the cleaning unit and the belt 7.

Meanwhile, the control circuit begins to drive a sheet feeder roller 12 with a preset timing, so that one of the sheets 40 in the cassette 11 is separated from the rest, is fed into the apparatus main assembly 38B, and is delivered to a pair of registration rollers 13. Further, the control circuit moves the second transfer roller 9 from the preset position in which the roller 9 was kept away from the belt 7, to a preset position in which the roller 9 is kept pressed against the roller 71 with the presence of the belt 7 between itself and roller 71. Then, the sheet 40 is introduced into the second transfer nip, which is the area of contact between the second transfer roller 9 and belt 7, by the pair of registration roller 13 with a preset timing, while the second transfer bias (voltage) which is opposite in polarity to the polarity of toner charge, is applied to the roller 9. Thus, the synthetic color toner image, that is, the layered combination of the four monochromatic toner images, different in color, on the belt 7, is transferred all at once (second transfer) onto the sheet 40.

As the sheet 40 comes out of the second transfer nip, it is separated from the belt 7, and sent to a fixing device 14, in which the sheet 40 and the multicolor toner image thereon are subject to heat and pressure, whereby the full-color toner image is fixed to the surface of the sheet 40, becoming a fixed full-color toner image on the sheet 40. Then, the sheet 40 is discharged onto the delivery tray 15*a*, which is a part of the top wall 15 of the apparatus 38. As soon as the trailing edge of the sheet 40 comes out of the second transfer nip, the second transfer roller 9 is returned to the aforementioned preset position in which it is kept on standby. The unit 10 is moved into its preset position in which it acts on the belt 7, in synchronism with the arrival of the leading edge of the sheet 40 at the second transfer nip, so that the second transfer residual toner, that is, the toner which failed to be transferred onto the sheet 40 from the belt 7, is removed by the unit 10. Then, as soon as the trailing edge of the sheet 40 comes out of the second transfer nip, the unit 10 is returned to its standby position, in which it is held until the next cleaning operation. It is not mandatory that the multiple monochromatic toner images, different in color, are formed on the peripheral surface of the drum 2 in the above described order. Obviously, not only can the apparatus 38 be used for the formation of full-color images, but also, monochromatic color images as well as black-and-white images.

(Development Cartridge)

Figure 2:
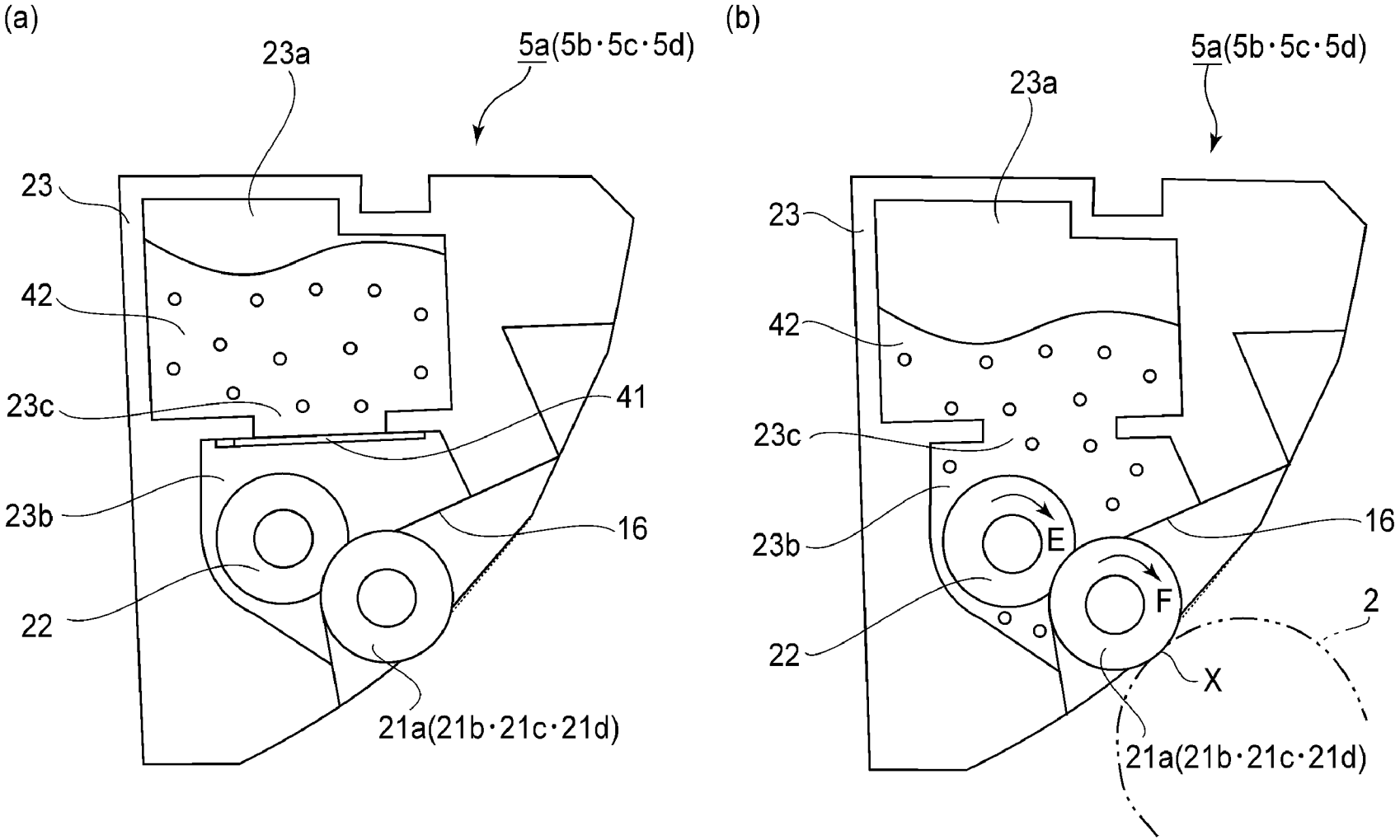
FIGS. 2(*a*) and 2(*b*) are schematic cross-sectional views of a part of the development cartridge in the first embodiment.

The development cartridges 5*a*, 5*b*, 5*c*, and 5*d* are the same in structure. Thus, the structure of only the yellow (Y) development cartridge 5*a* is described. FIGS. 2(*a*) and 2(*b*) are schematic cross-sectional views of the development cartridge 5*a*. The development cartridge frame comprises: a toner storage chamber 23*a*; and a development chamber 23*b*, in which the development roller 21*a* and a toner supply roller 22 are located. The two chambers 23*a* and 23*b* are in connection with each other through the opening 23*c*. Until the development cartridge 5*a* is delivered to a user, more specifically, until it is used for the first time, the toner storage chamber 23*a* and development chamber 23*b* are kept separated by the attachment of a toner seal 41, which is a piece of film, for example, to the inward surface of the development chamber 23*b* in a manner to block the opening 23*a*, by welding or the like method. Before the development cartridge 5*a* is used (mounted into apparatus main assembly) for the first time, the toner seal 41 has to be removed to allow the toner 42 in the toner storage chamber 23*a* to be supplied to the development chamber 23*b*.

The development cartridge 5*a* is mounted into the rotary 1 as described above. Then, as it is moved into the development position X (in which it directly opposes drum 2), the toner in the toner storage chamber 23*a* free-falls into the development chamber 23*b*, supplying thereby the toner supply roller 22 in the development chamber 23*b* with the toner 42. Not only does the toner supply roller 22 supply the roller 21*a* with the toner 42, but also, it plays the role of scraping down the residual toner from the roller 21*a*. The roller 21*a* is an elastic rubber roller, and is rotated in the direction indicated by an arrow mark F. As the roller 21*a* is rotated, the layer of toner 42 on the peripheral surface of the roller 21*a* is regulated in thickness by a development blade 16, and then, is supplied to the drum 2 to develop the electrostatic latent image on the drum 2. The toner (42) remaining on the roller 21*a* after the development of the electrostatic latent image is removed by the roller 22, in the area of frictional contact between the rollers 21*a* and 22. Then, the portion of the peripheral surface of the roller 21*a*, from which the residual toner (42) has just been removed, is supplied again with the toner 42 by the roller 22. In order to ensure that the roller 21*a* remains in contact with the drum 2 in the development position X, the development cartridge 5*a* is kept pressed toward the drum 2 by keeping the rotary 1 (in which development 5*a* is held) pressed toward the drum 2. With this structural arrangement, the development roller 21*a* of the development cartridge 5*a* is kept pressed upon the drum 2 so that a preset amount of contact pressure is maintained between the development roller 21*a* and drum 2. In terms of the development operation, the development cartridges 5*b*, 5*c*, and 5*d* are the same as the development cartridge 5*a*.

(Drum Cartridge)

Figure 1:
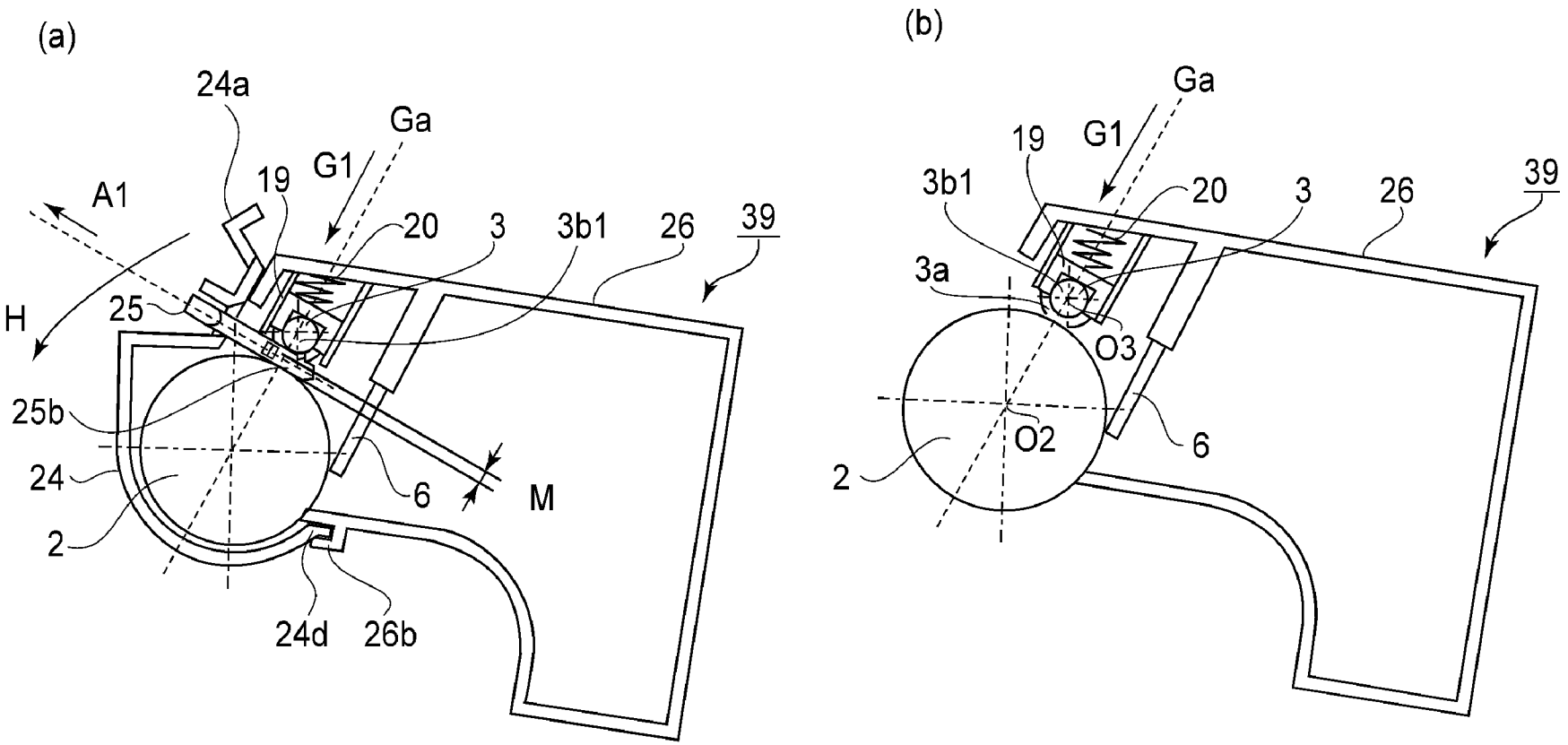
FIG. 1(*a*) is a schematic sectional view of the combination of the drum cartridge, cartridge cover, and a spacer, in the first preferred embodiment of the present invention, and FIG. 1(*b*) is a schematic cross-sectional view of the drum cartridge.
Figure 9:
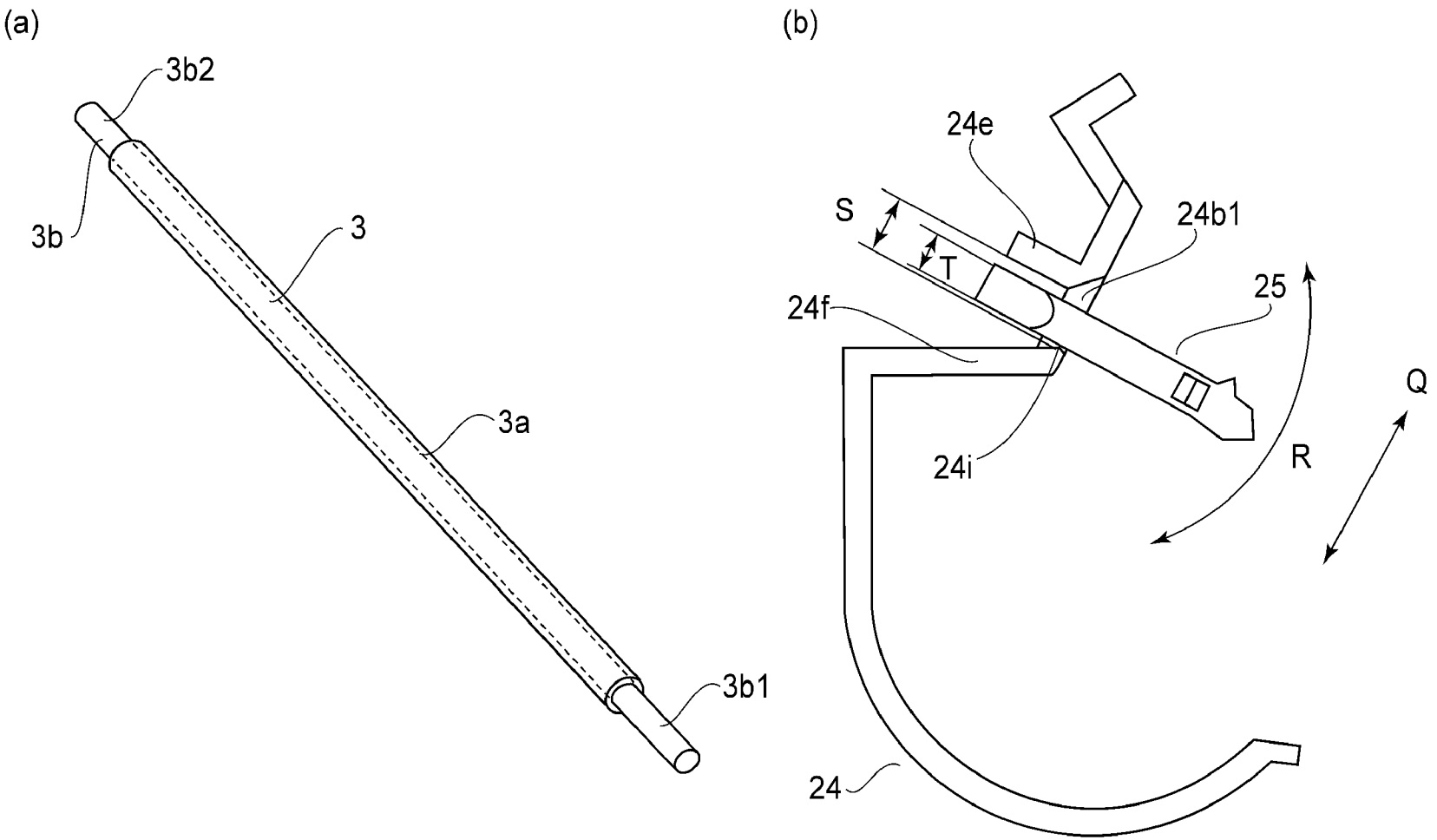
FIG. 9(*a*) is a perspective view of the charge roller, and FIG. 9(*b*) is a cross-sectional view of the combination of the cover and spacer, and shows the general structure thereof.

Next, the drum cartridge 39 will be described. FIG. 1(*b*) is a schematic sectional view of the drum cartridge 39 in this embodiment. FIG. 9(*a*) is a perspective view of the charging means 3, which is in the form of a roller (charge roller). The drum cartridge 39 in this embodiment comprises: a drum cartridge frame 26 (waste toner container), drum 2, charging means 3, and cleaning means 6. The drum 2, charging means 3, and cleaning means 6 are integrally held in the cartridge frame 26 in the preset positional relationship. The charging means 3 uniformly charges the peripheral surface of the drum 2 to the preset polarity and potential level, for the formation of an electrostatic latent image. The cleaning means 6 removes the transfer residual toner on the drum 2, and stores the removed transfer residual toner in the waste toner storage chamber of the drum cartridge frame 26. Next, referring to FIGS. 3(*a*), 3(*b*), and 4(*a*), the cartridge 39 is removably mounted into the cartridge space 38C in the apparatus main assembly 38A by a user following a preset procedure, and then, is precisely positioned, and kept precisely position, relative to the apparatus main assembly 38A by a drum cartridge positioning means (unshown). While the cartridge 39 remains precisely positioned relative to the apparatus main assembly 38A, it remains mechanically and electrically connected to the main assembly 38A, being thereby enabled to receive mechanical driving force, charge bias, and development bias, from the apparatus main assembly 38A. The means for mounting or dismounting of the cartridge 39, operation for mounting or dismounting the cartridge 39, cartridge positioning means, etc., are not directly related to the gist of the present invention, and therefore, are not going to be described here.

The charging means 3 in this embodiment is of the so-called roller type. Referring to FIG. 9(*a*), the charge roller 3 comprises a cylindrical and elastic rubber layer 3*a* (rubber portion) and a rigid shaft 3*b* (by which rubber layer is rotatably supported by frame 26). The rigid shaft 3*b* is longer than the rubber layer 3*a*, in terms of the direction of the rotational axis of the drum 2. It extends through the cylindrical rubber layer. The positional relationship between the rigid shaft 3*b* and rubber layer 3*a* is such that the lengthwise end portions of the shaft 3*b* protrude from the corresponding lengthwise ends of the rubber layer 3*a*. These portions of the rigid shaft 3*b*, which are protruding from the corresponding lengthwise ends of the rubber layer 3*a* will be referred to as protruding portions 3*b*1 and 3*b*2. Next, referring to FIG. 1(*b*), each of charge roller bearings 19 is attached to the frame 26 in such a manner that its center line in terms of the diameter direction of the charge roller 3 coincides with a line Ga which coincides with the rotational axis O3 of the roller 3 and the rotational axis O2 of the drum 2, and also, that it is movable in the direction parallel to the line Ga. The protruding portions 3*b*1 of the roller 3 is rotatably supported by the bearings 19, which are kept pressured in the direction indicated by an arrow mark G1, that is, toward the drum 2, by a charge roller pressing member 20, and so is the protruding portion 3*b*2.

(Drum Cover and Spacer)

Figure 4:
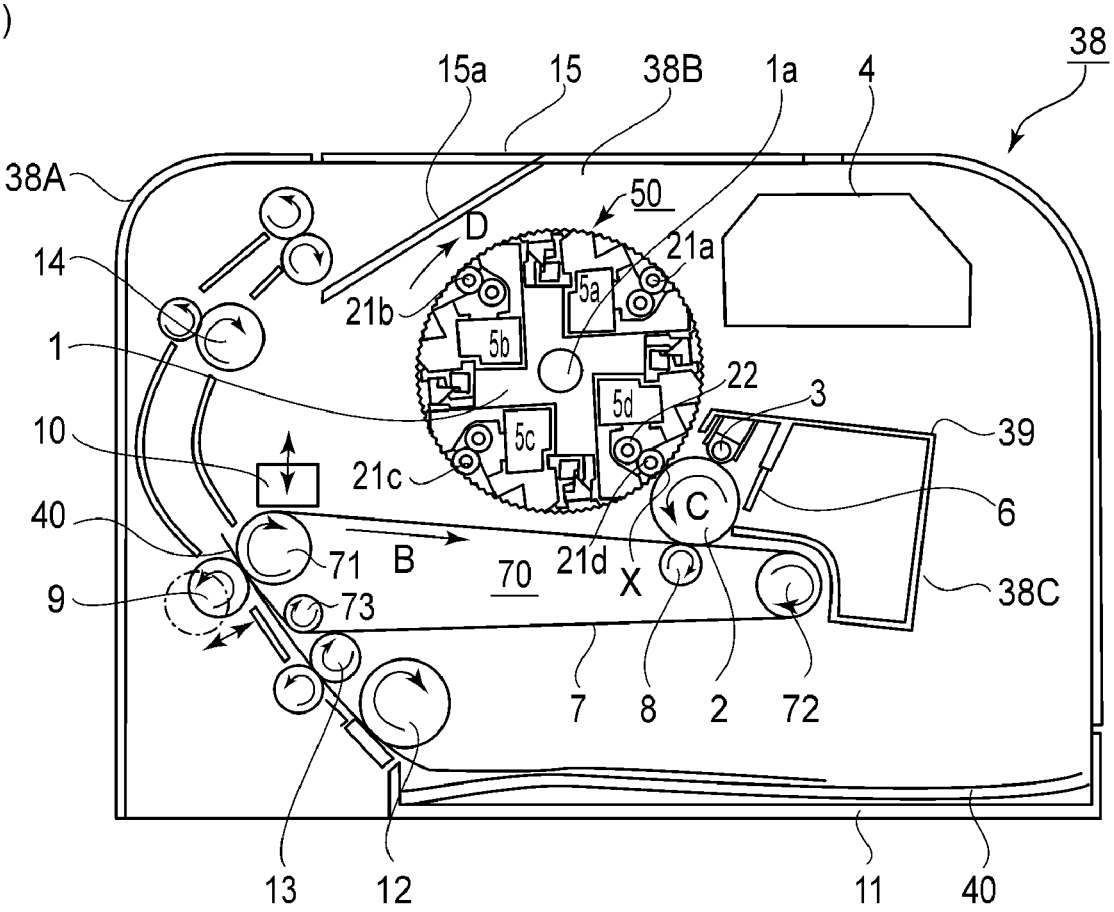
FIG. 4(*a*) is a schematic sectional view of the electrophotographic image forming apparatus in the first embodiment, and shows the general structure of the apparatus, and FIG. 4(*b*) is a perspective view of the spacer in the first embodiment.
Figure 4:
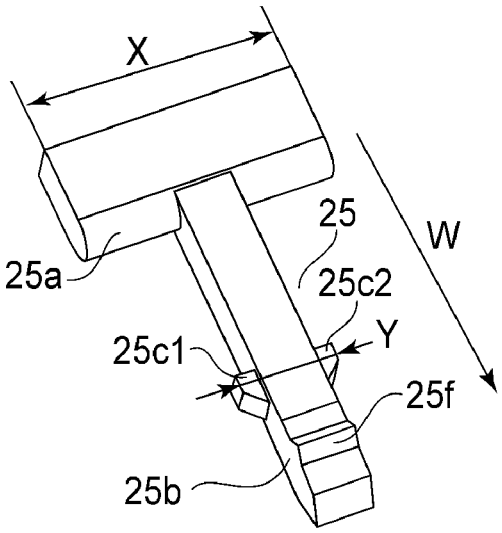
Figure 5:
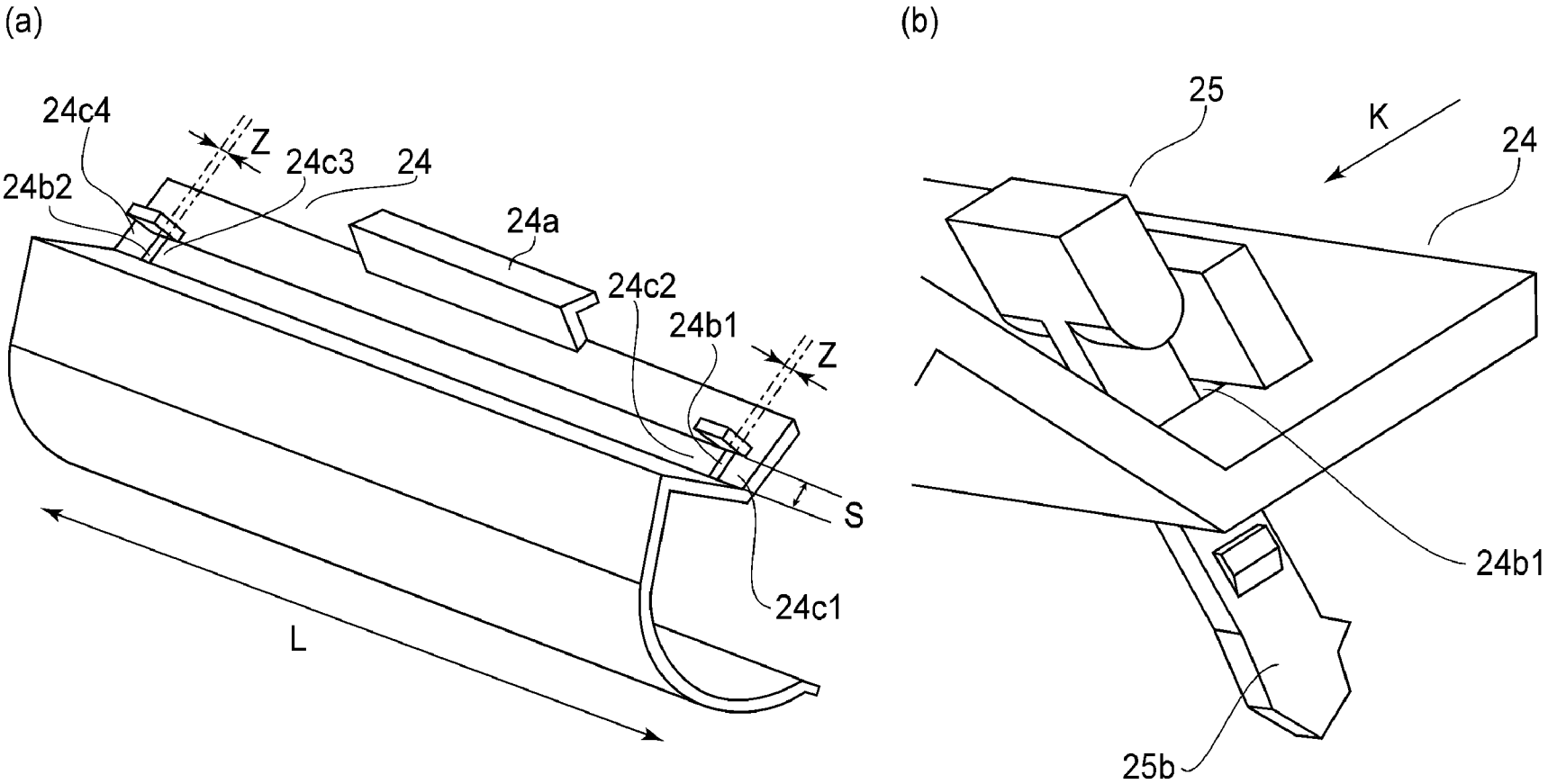
FIG. 5(*a*) is a perspective view of the drum cartridge cover in the first embodiment, and FIG. 5(*b*) is an enlarged perspective view of a combination of one of the lengthwise end portions of the cover, and one of the spacers, after the attachment of the spacer to the cover.
Figure 17:
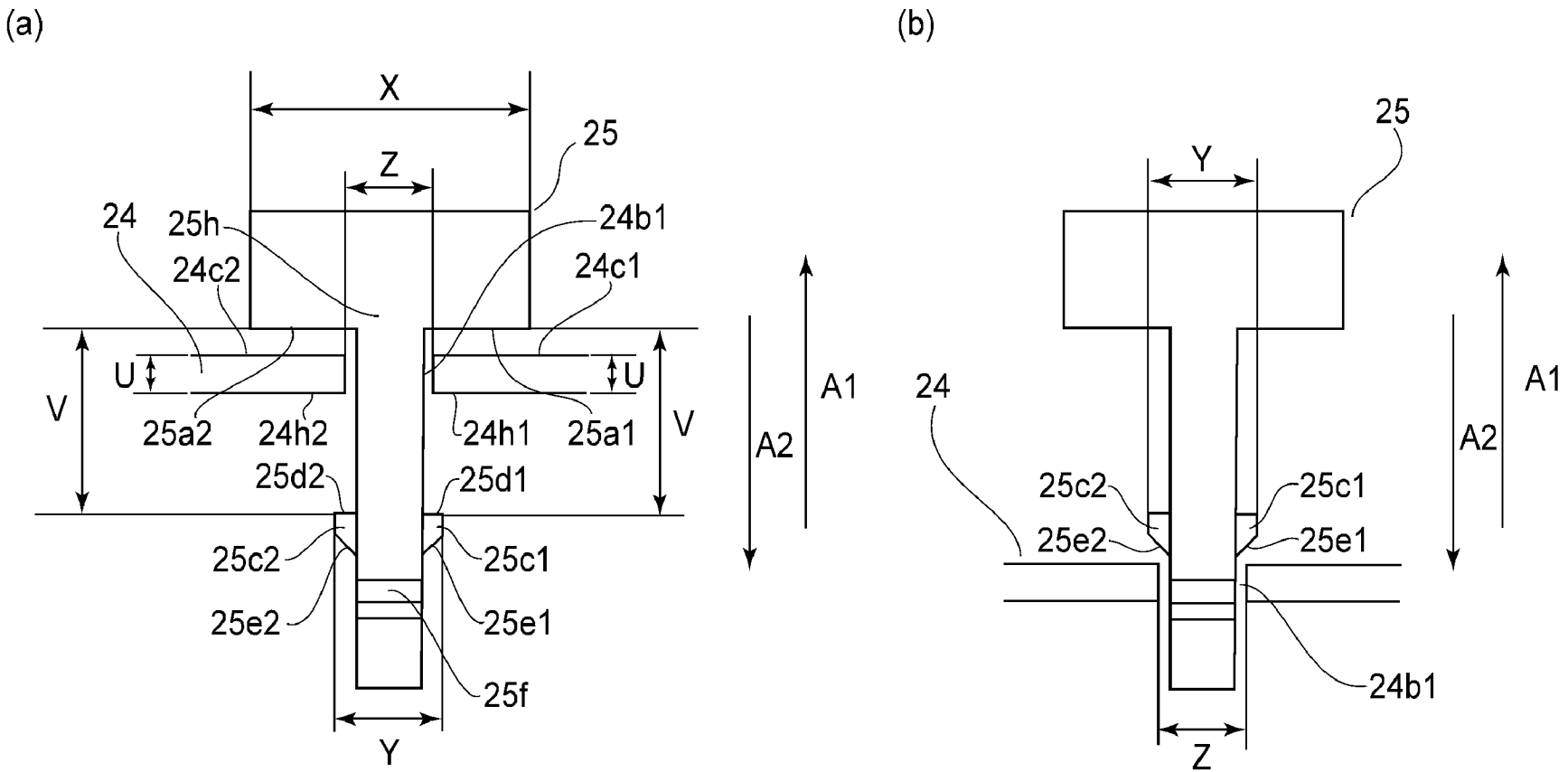
FIG. 17 is a schematic plan view of the combination of the drum cover and spacer, as seen from the direction perpendicular to the actual spacing portion of the spacer.

Next, the cover 24 and spacer 25 in this embodiment will be described. The cover 24 is for protecting the drum 2. The spacer 25 is for keeping the drum 2 and charge roller 3 separated from each other. FIG. 1(*a*) is a schematic cross-sectional view of the drum cartridge 39 fitted with the drum cover 24 and spacer 25. FIG. 4(*b*) is a perspective view of the spacer 25. FIG. 5(*a*) is a perspective view of the drum cover 24, and FIG. 5(*b*) is an enlarged perspective view of one of the lengthwise end portions the drum cover 24 fitted with the spacer 25. FIG. 17(*a*) is a sectional view of the portion of the drum cover 24 shown in FIG. 5(*b*), at a plane perpendicular to the direction indicated by an arrow mark K in FIG. 5(*b*).

In order for an electrostatic latent image to be formed on the drum 2 in the cartridge 39, developed, and transferred, the peripheral surface of the drum 2 has be widely exposed as shown in FIG. 1(*b*). However, if the peripheral surface of the drum 2 is left widely exposed during the period from when the cartridge 39 is shipped out of its factory and to when it is mounted into the cartridge space 38C in the apparatus main assembly 38A, it is liable for the drum 2 to be damaged. Thus, a brand-new cartridge 39 is fitted with the drum cover 24, as shown in FIG. 1(*a*), to protect the drum 2 until the cartridge 39 is delivered to a user and used for the first time, in particular, during the commercial distribution of the cartridge 39.

Also referring to FIG. 1(*b*), in order to keep the peripheral surface of the charge roller 3 in contact with the peripheral surface of the drum 2, the charge roller 3 is kept pressed toward the drum 2 by a pressing member 20. Thus, if the drum cartridge 39 is left unattended for a substantial length of time, the rubber portion 3*a* of the charge roller 3, which is elastic, is liable to deform. This problem can be prevented by strictly controlling the material for the charge roller 3 and the condition under which the charged roller 3 is manufactured. However, such a measure creates problems in terms of the manufacture of the charge roller 3. There is another solution to the abovementioned deformation of the charge roller 3, which is to keep the peripheral surface of the drum 2 separated from the peripheral surface of the elastic surface layer 3*a* (rubber layer) of the charge roller 3 until the drum cartridge 39 is delivered to a user, more specifically, until the drum cartridge 39 is used for the first time.

In this embodiment, the spacer 25 is inserted between the protruding portion 3*b*1 of the rigid shaft 3*b* of the roller 3 and the peripheral surface of the drum 2 to keep the elastic rubber layer portion 3*a* of the roller 3 separated from the peripheral surface of the drum 2, as shown in FIG. 1(*a*). The spacer 25 may be placed between both, or one, of the protruding portions 3*b*1 and 3*b*2 of the rigid shaft 3*b* of the charge roller 3, and the peripheral surface of the drum 2. That is, in terms of the direction parallel to the axial line of the drum 2, the spacer 25 is placed at both, or one, of the lengthwise ends of the drum 2 (charge roller 3).

Figure 6:
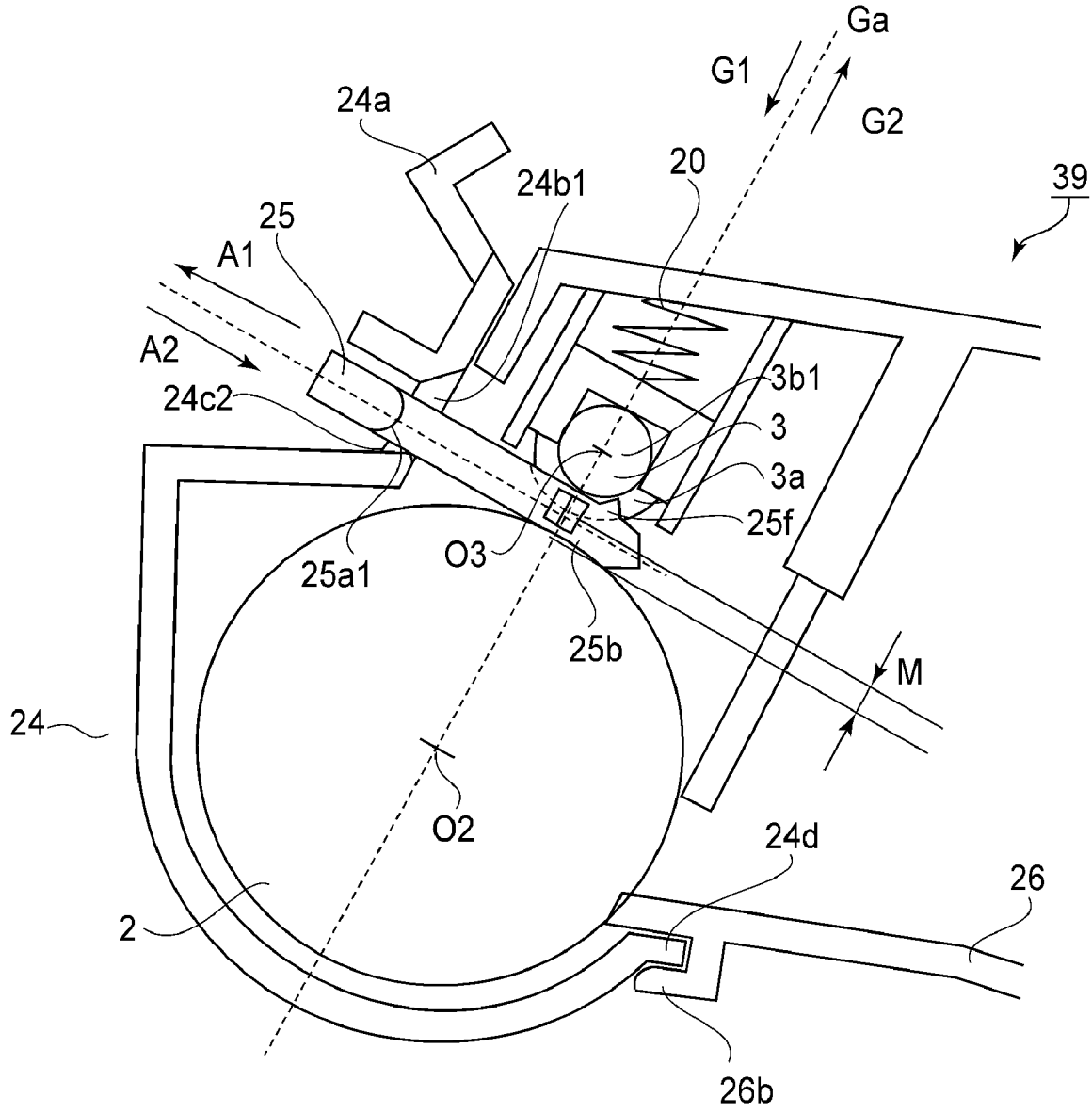
FIG. 6 is a schematic cross-sectional view of the drum cartridge in the first embodiment, and shows the general structure of the cartridge fitted with the combination of the cover and spacer.

Next, referring to FIGS. 4(*b*) and 6, the spacer 25 is provided with a stopper projection 25*f* for preventing the spacer 25 from easily slipping out from between the protruding portion 3*b*1 of the rigid shaft 3*b*, and the peripheral surface of the drum 2, in the direction indicated by an arrow mark A1 in FIG. 6. All that is necessary to allow the peripheral surface of the drum 2 and the peripheral surface of the roller 3 to come into contact with each other is to move the spacer 25 in the direction indicated by the arrow mark A1. As the spacer 25 is moved in the direction of the arrow mark A1, the stopper portion 25*f* of the spacer 25 is moved under the protruding portion 3*b*1 of the roller 3 which is being kept pressed toward the drum 2 by the pressing member 20. Thus, the protruding portion 3*b*1 is moved in the direction indicated an arrow mark G2.

Further, even if the spacer 25 is pressed in the direction indicated by the arrow mark A1 because of the impacts or the like which occur during the commercial shipment of the cartridge 39, the presence of the stopper projection 25*f* makes it necessary for the protruding portion 3*b*1 of the roller 3 to be moved in the direction indicated by the arrow mark G2 in order for the spacer 25 to be allowed to move in the direction indicated by the arrow mark A1. However, the protruding portion 3*b*1 is under the pressure from the pressing member 20, being therefore prevented from moving in the direction of the arrow mark G2. Therefore, it is unlikely for the spacer 25 to easily come out from between the protruding portion 3*b*1 of the roller 3, and the photosensitive drum 2.

Next, the structural arrangement for keeping the spacer 25 movably attached to the cover 24 is described. Referring to FIG. 5(*a*), the cover 24 is provided with a pair of through holes 24*b*1 and 24*b*2 (through which pair of spacers 25 are put), which are in the end portions of the cover 24 in terms of the lengthwise direction of the cartridge 39 (indicated by arrow mark L). Next, referring to FIGS. 5(*b*) and 6, the spacer 25 is put through the through hole 24*b* of the cover 24 so that the spacing portion 25*b* of the spacer 25 is inserted between the drum 2 and the protruding portion 3*b*1 of the roller 3. Thus, the peripheral surface of the drum 2 and the peripheral surface of the elastic portion 3*a* of the roller 3 are separated, and kept separated, by the distance M as shown in FIG. 1(*a*).

Referring to FIG. 17(*a*), the spacer 25 is provided with a pair of insertion distance control surfaces 25*a*1 and 25*a*2 (control portions) for regulating the distance by which the spacer 25 is allowed to be inserted into the cover 24 in the direction (indicated by arrow mark A2) to insert the spacer 25 between the drum 2 and roller 3. In this embodiment, the spacer 25 is formed so that its width X becomes greater than the width Z of the through hole 24*b*1 of the cover 24. Thus, as the spacer 25 is inserted through the through hole 24*b*1 of the cover 24, the pair of insertion distance control surfaces 25*a*1 and 25*a*2 come into contact with a pair of spacer insertion distance control surfaces 24*c*1 and 24*c*2 of the cover 24, preventing thereby the spacer 25 from being moved further relative to the cover 24 in the direction indicated by the arrow mark A2.

Referring also to FIG. 17(*a*), the spacer 25 is provided with also a pair of disengagement stopper portions 25*c*1 and 25*c*2 for preventing the spacer 25 from becoming completely disengaged from the cover 24. In this embodiment, the width Y of each of the disengagement preventing portions 25*c*1 and 25*c*2 is made greater than the width Z of the through hole 24*b*1. Thus, as the spacer 25 is moved in the direction to be disengaged from the cover 24, its disengagement preventing portions 24*d*1 and 24*d*2 come into contact with the spacer disengagement preventing surfaces 24*h*1 and 24*h*2 of the cover 24, which are on inward side of the cover 24, preventing thereby the spacer 25 from completely disengaging from the cover 24.

The disengagement preventing portions 25*c*1 and 25*c*2 have slanted spacer guiding surfaces 25*e*1 and 25*e*2, which are opposite surfaces of the disengagement preventing surfaces 25*a*1 and 25*a*2, respectively, in terms of the direction (indicated by arrow mark A2) in which the spacer 25 is put through the through holes 24*b*1. Incidentally, the above described disengagement preventing surfaces 25*d*1 and 25*d*2 are perpendicular to the direction (indicated by arrow mark A1) in which the spacer 25 disengages from the cover 24. Since the disengagement preventing portions 25*c*1 and 25*c*2 are shaped as described above, it is easier for the spacer 25 to be put through the through hole 24*b* of the cover 24 in the spacer insertion direction (indicated by arrow mark A2), and also, once the spacer 25 is inserted far enough for the disengagement preventing portions 25*c*1 and 25*c*2 to be placed beyond the through hole 24*b*, it is unlikely for the spacer 25 to completely disengage from the cover 24. Further, the cover 24 and spacer 25 are formed so that the distance V between the insertion distance control surface 25*a*1 and 25*a*2 and the disengagement prevention surface 25*d*1 and 25*d*2 of the disengagement preventing portions 25*c*1 and 25*c*2, respectively, becomes substantially greater than the thickness U of the cover 24. Thus, even after the spacer 25 is put through the through hole 24*b*1 of the cover 24, it is movable (allowed to move) in the directions (indicated by arrow marks A1 and A2 in FIG. 17(*a*)) in which the spacer 25 is put through the through hole 24*b*1 or disengaged from the cover 24.

Next, referring to FIGS. 5(*a*) and 9(*b*), the cover 24 and spacer 25 are formed so that in terms of the direction perpendicular to the lengthwise direction of the cover 24, the dimension S (width) of the through hole 24*b*1 of the cover 24 becomes greater than the dimension T (thickness) of the spacer 25. Therefore, even after the spacer 25 is put through the through hole 24*b*1, the spacer 25 is movable (allowed to move) in the directions indicated by arrow marks R and W. Further, the cover 24 is provided with a pair of spacer movement control walls 24*e* and 24*f* which regulate the range in which the spacer 25 is allowed to move.

Next, the structural arrangement for keeping the cover 24 attached to the cartridge 39 by the spacer 25 is described. Referring to FIG. 6, the cover 24 is anchored to the frame 26 by fitting the cover anchoring portion 24*d* into the cover anchoring groove 26*b* of the frame 26. Then, the spacer 25 is inserted through the through hole 24*b*1, and pushed inward of the frame 26 until the disengagement prevention projection 25*f* of the spacer 25 reaches beyond the line Ga which coincides with the axial line O2 of the drum 2 and the axial line O3 of the roller 3. As the spacer 25 is inserted as far as described above, the cover 24 is become secured to the cartridge 39 for the following reasons. That is, the movement of the stopper projection 25*f* is regulated by the drum 2 and the protruding portions 3*b*1 and 3*b*2 of the roller 3. Therefore, the stopper projection 25*f* comes into contact with the disengagement prevention surface 24*c* of the cover 24, and therefore, the cover 24 is prevented from moving in its disengagement direction. Further, in this embodiment, the cover anchoring portion 26*b* of the frame 26, which is for keeping the cover 24 attached to the cartridge 39, is a part of the frame 26. However, it may be formed as a part of one of the components of the cartridge 39, other than the frame 26.

(Removal of Drum Cover and Spacer)

Figure 7:
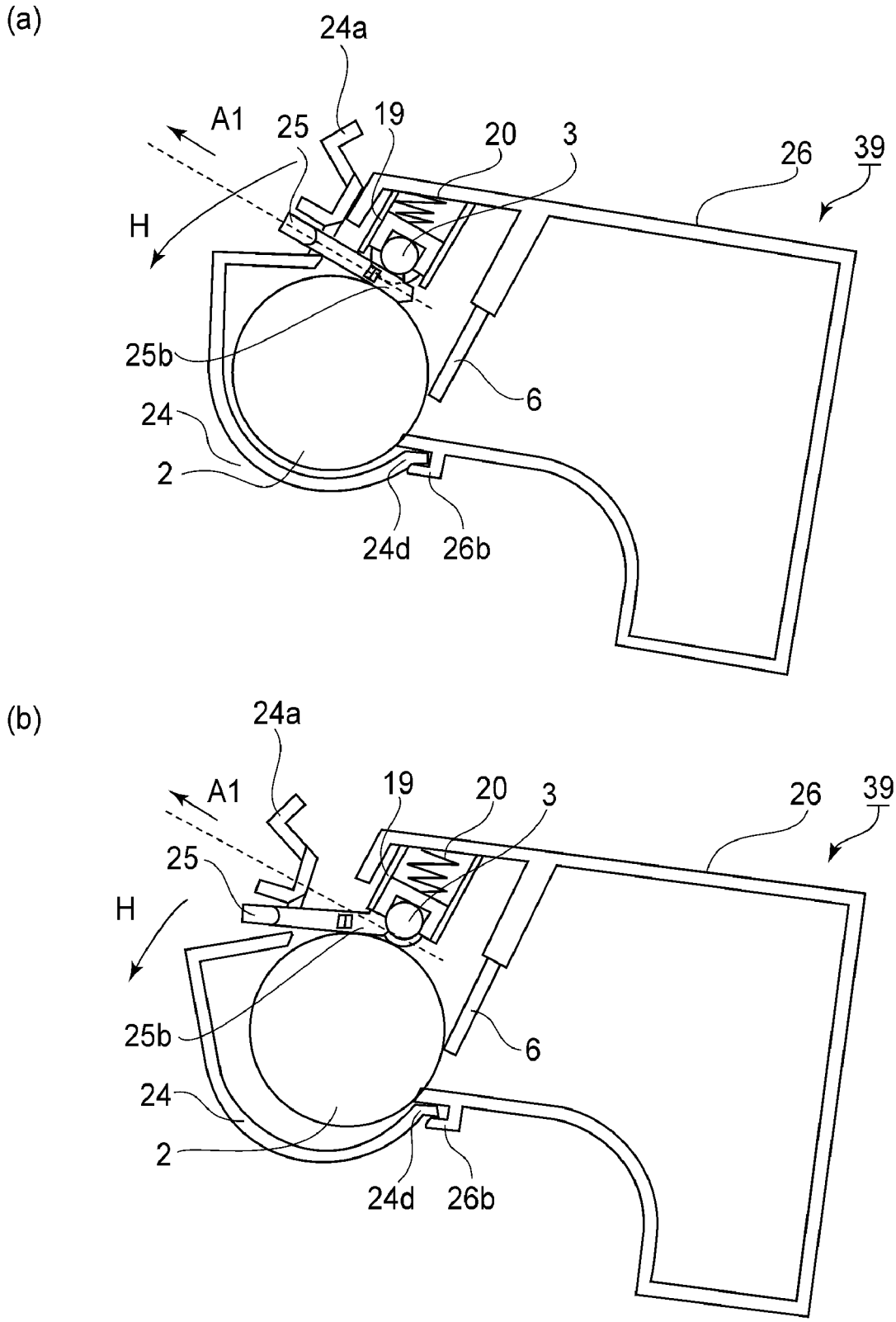
FIGS. 7(*a*) and 7(*b*) are schematic cross-sectional views of the combination of the drum cartridge, drum cover, and spacer, which are for describing the operation for removing the spacer to allow the photosensitive drum and charge roller to be placed in contact with each other.

Next, the removal of the cover 24 and spacer 25 is described. FIGS. 7(*a*), 7(*b*), 8(*a*), and 8(*b*) are schematic cross-sectional views of the combination of the cartridge 39 and the cover 24 and spacer 25 for the drum cartridge 39, and show how the cover 24 and spacer 25 are removed to allow the drum 2 and roller 3 to be placed in contact with each other. Referring to FIG. 5(*a*), the cover 24 is provided with a handhold 24*a*, which is to be grasped by a user when the cover 24 is to be removed from the cartridge 39. More specifically, a user can remove the cover 24 from the cartridge 39 by grasping the handhold 24*a*, and rotating the cover 24 in the direction indicated by an arrow mark H about the anchoring portion 24*d*, which is in engagement with the cover anchoring groove 23*b* of the cartridge 39.

Figure 8:
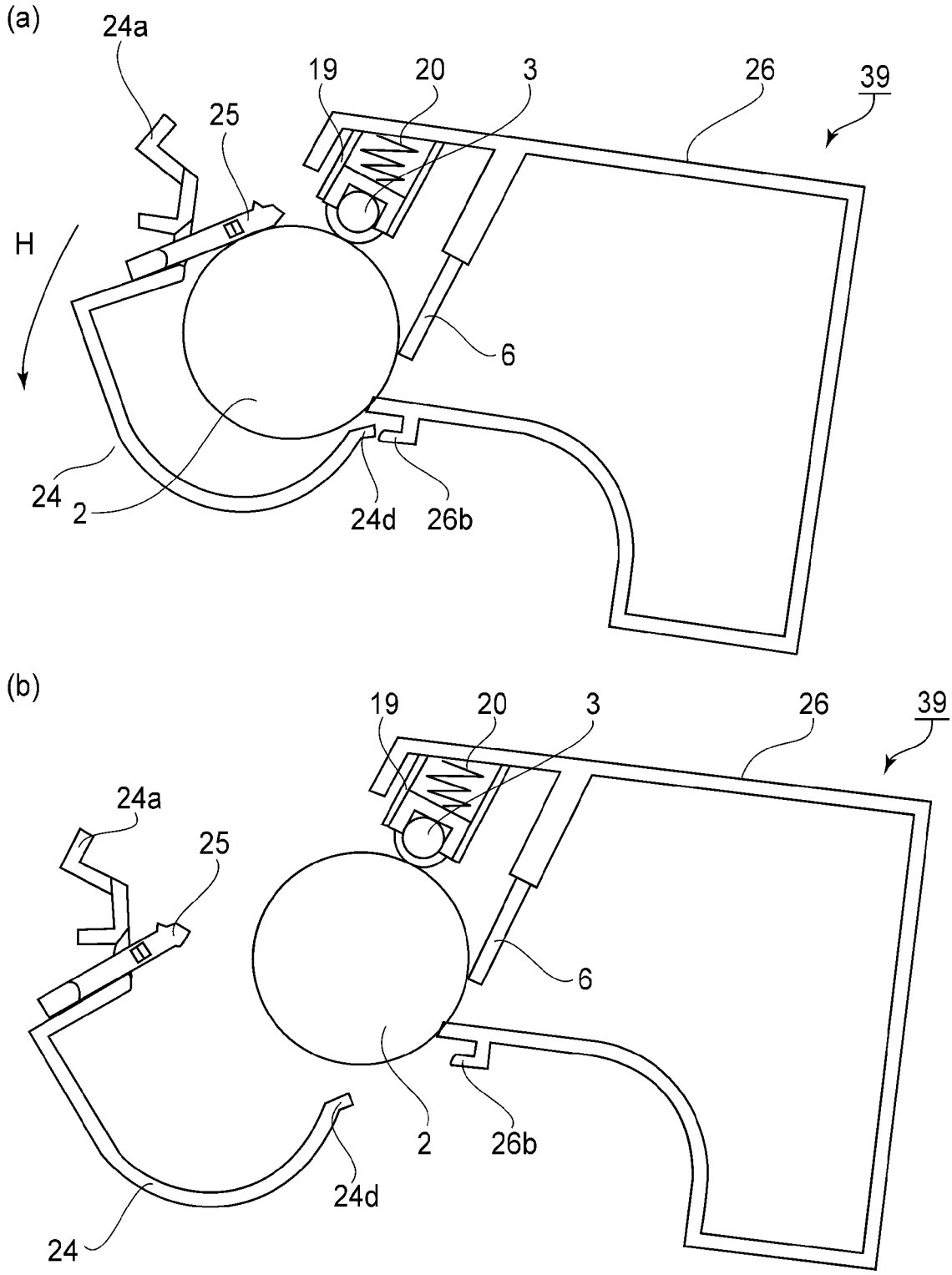
FIGS. 8(*a*) and 8(*b*) are schematic cross-sectional views of the combination of the drum cartridge, drum cover, and spacer, which are for describing the operation for removing the spacer to allow the photosensitive drum and charge roller to be placed in contact with each other.

As the cover 24 is rotated as described above, the spacer 25 is moved by the cover movement caused by the user to remove the cover 24, that is, the movement of the cover 24 in the direction indicated by the arrow mark H, whereby the spacer 25 is pulled out from between the drum 2 and protruding portion 3*b*1. This is possible because as the cover 24 is moved in the arrow H direction, the spacer insertion distance control surfaces 24*c*1 and 24*c*2 (FIG. 5) come into contact with the spacer insertion distance control surface 25*a*1 and 25*a*2 of the spacer 25, and push the spacing portion 25*b* of the spacer 25 in the direction indicated by the arrow mark A1 (surfaces 25*a*1 and 25*a*2 catch such force that works in the direction to move the direction indicate by the arrow mark A1), as shown in FIGS. 7 and 8. Since the spacer 25 is movably (loosely) attached to the cover 24, all that is necessary for a user to do to allow the peripheral surface of the rubber portion 3*a* (elastic layer) of the roller 3 to come into contact with the peripheral surface of the drum 2 is to remove the cover 24 from the drum cartridge 39.

(Method for Reattaching Cover and Space to Drum Cartridge)

Figure 11:
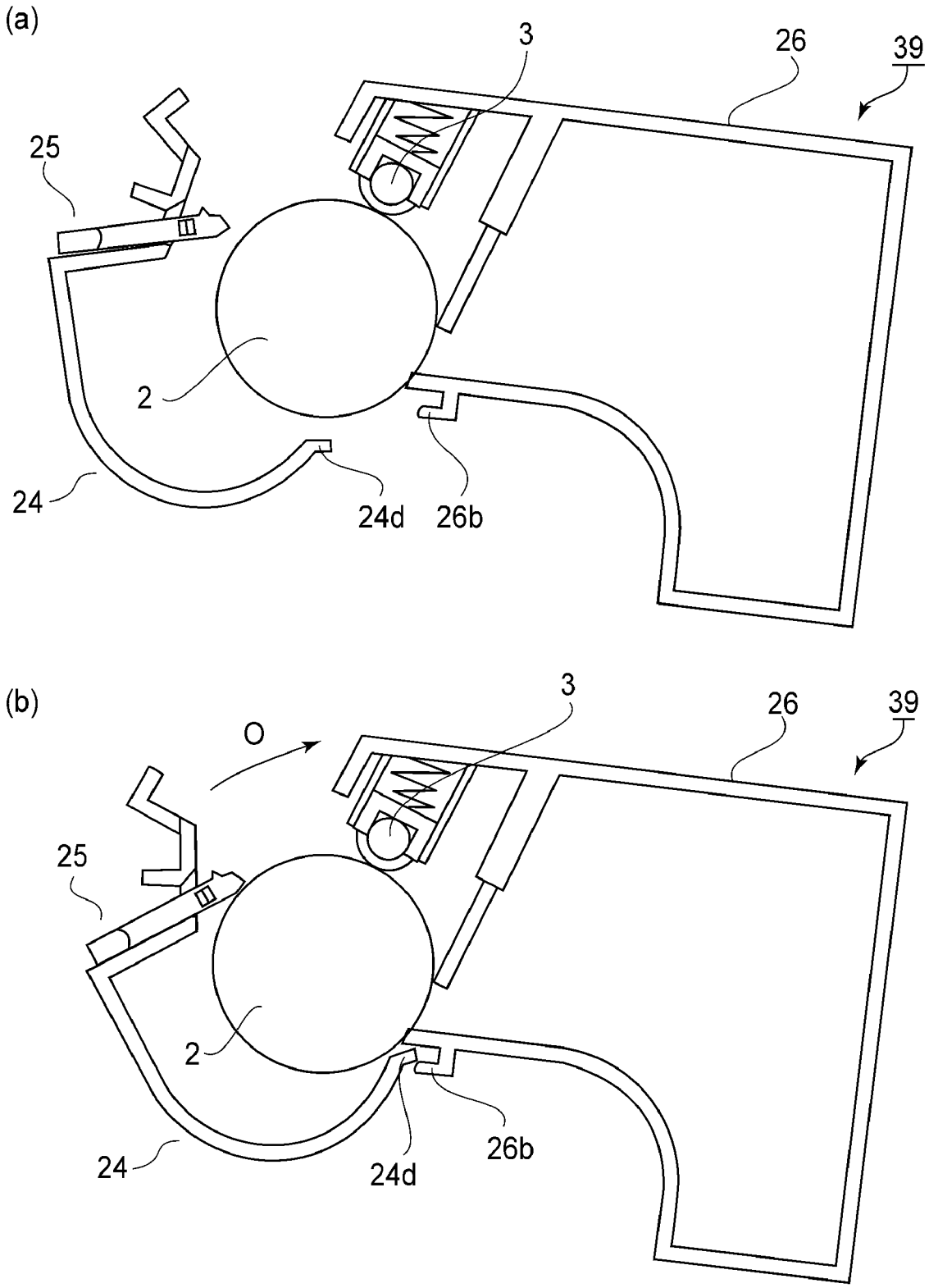
FIGS. 11(*a*) and 11(*b*) are schematic cross-sectional view of the drum cartridge, drum cover, and drum spacer, which is for describing the operation for attaching the drum cover and drum spacer to the drum cartridge.
Figure 12:
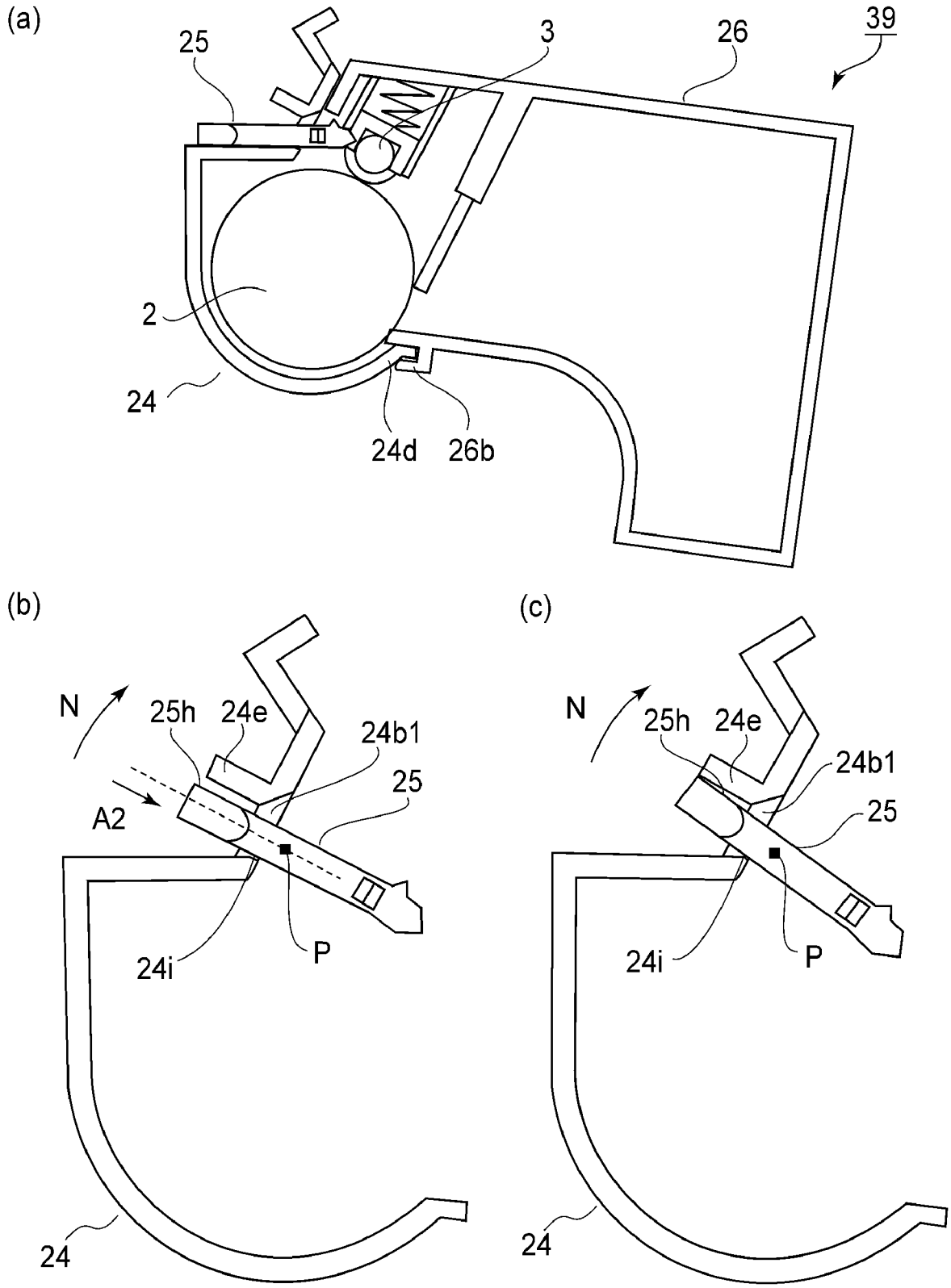
FIG. 12(*a*) is a schematic cross-sectional view of the drum cartridge, which is for describing the operation for attaching the cover to the drum cartridge.
Figure 18:
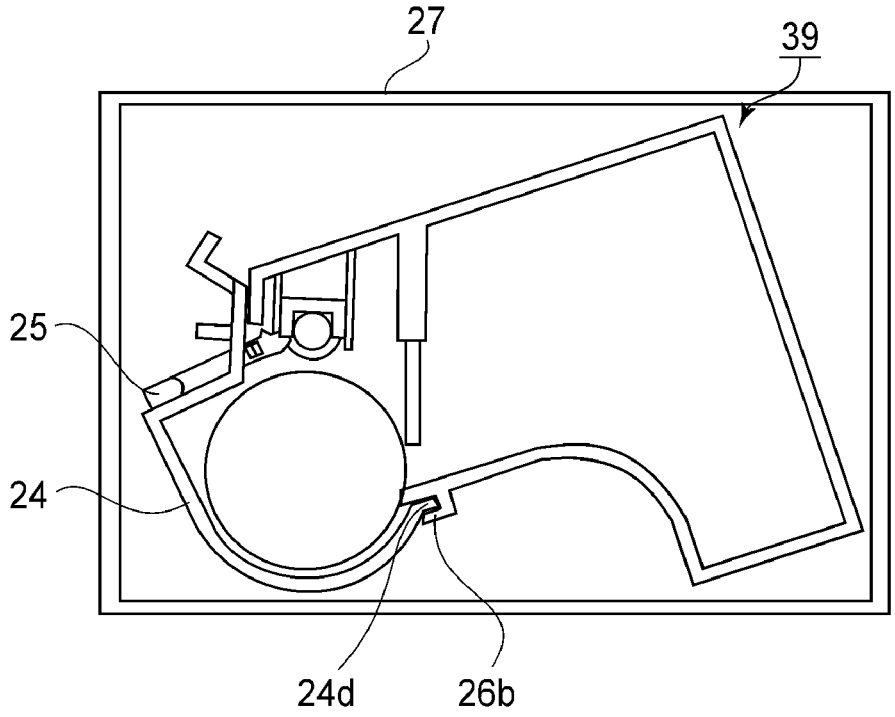
FIGS. 18(*a*) and 18(*b*) are schematic cross sectional views of the combination of the drum cartridge recycle box, drum cartridge, drum cover, and spacer, after the placement of the drum cartridge fitted with the drum cover and spacer, in the cartridge drum recycle box.
Figure 18:
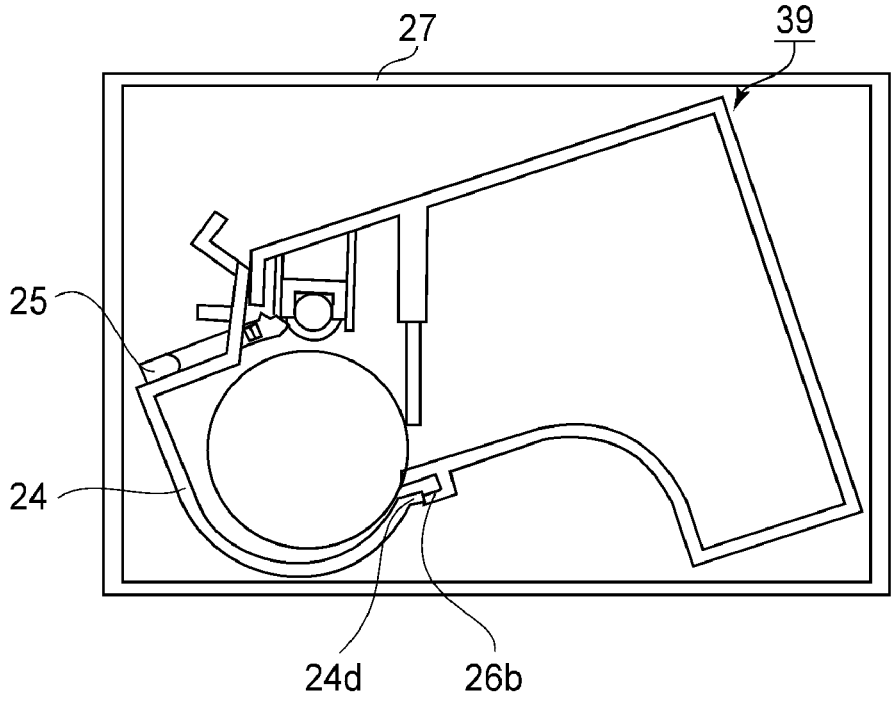

Next, the method for reattaching the cover 24 and spacer 25 to the drum cartridge 39 to prepare the cartridge 39 for recycling is described. FIGS. 11, 12(*a*), 13, 14, and 15 are schematic cross-sectional views of the combination of the cartridge 39, cover 24, and spacer 25, which are in the process of reattaching cover 24 and spacer 25 to the cartridge 39. FIGS. 18(*a*) and 18(*b*) are schematic cross-sectional views of the cartridge 39 refitted with the cover 24 and 25, and the cartridge recycle box 27 in which the cartridge 39 is.

In a case where a used cartridge 39 is stored outside the apparatus main assembly 38A for a substantial length of time, and/or a used-up cartridge 39 is shipped as recyclable cartridge to a recycling location, it is recommended to reattach the cover 24 to the cartridge 39 to protect the drum 2. In these cases, it is unnecessary for the cover 24 to be firmly attached to, or engaged with, the cartridge 39. That is, it is unnecessary for a user to insert the spacer 25 between the drum 2 and roller 3 as shown in FIG. 12(*a*). In the case of the drum cartridge 39 and cover 24 in this embodiment, the cover 24 can be attached to the cartridge 39 without inserting the spacer 25 between the drum 2 and roller 3. Further, the spacer 25 can be inserted between the peripheral surface of the drum 2 and the protruding portion 3*b*1 of the rigid shaft 3*b* to separate the rubber layer portion 3*a* of the roller 3 from the peripheral surface of the drum 2, as shown in FIG. 6, after the reattachment of the cover 24 to the cartridge 39. Since the drum cartridge 39, drum cover 24, and spacer 25 in this embodiment are structured as described above, the drum 2 can be protected when the cartridge 39 is stored outside the apparatus main assembly 38A for a substantial length of time. Further, the drum cartridge recycle box 27 in which the cartridge 39 fitted with the cover 24 can be stored as shown in FIG. 18(*a*) can be designed to be minimized in size, and therefore, can be improved in the efficiency with which it is transported for recycling.

As described above, the spacer 25 is controlled in movement by the spacer insertion distance control outward surfaces 24*c*1 and 24*c*2, spacer insertion distance control inward surfaces 24*h*1 and 24*h*2, and the spacer movement control walls 24*e* and 24*f* of the cover 24. Therefore, the spacer 25 is controlled in its movement relative to the cover 24 in the directions indicated by the arrow marks R and Q in FIG. 9(*b*).

Figure 10:
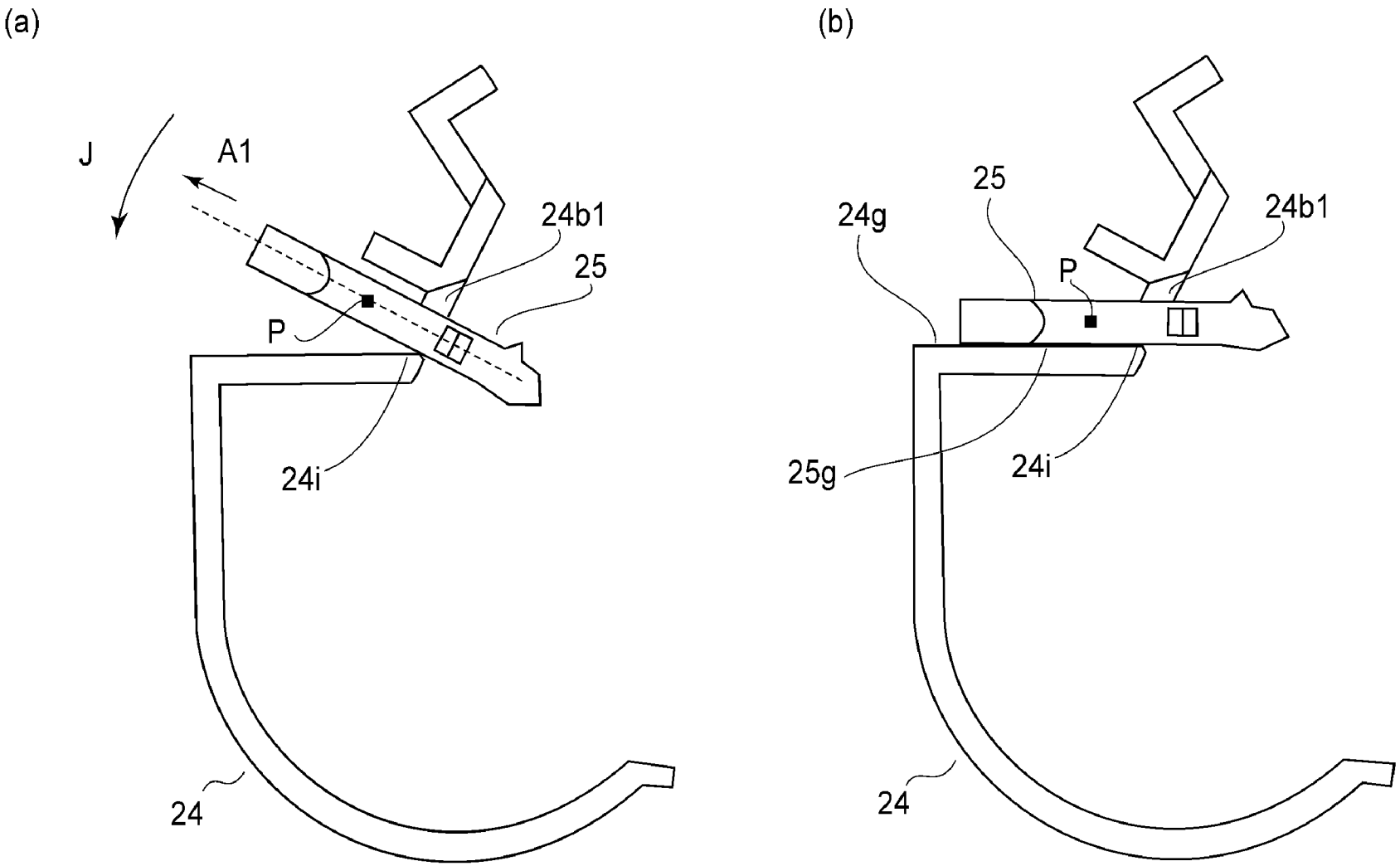
FIGS. 10(*a*) and 10(*b*) are schematic cross-sectional views of the combination of the cover and spacer, and shows the general structure thereof.

First, the operation for attaching the cover 24 to the cartridge 39 after not only was the cover 24 removed from the cartridge 39, but also, the spacer 25 was moved relative to the cover 24 in the direction indicated by the arrow mark A1 in FIG. 10(*a*), is described. After the spacer 25 was moved relative to the cover 24 in the direction indicated by the arrow mark A1, its surface 25*g* is in contact with the cover movement control surface 24*g* (cover holding portion) of the cover 24. This occurs because the center P of gravity of the spacer 25, is on the arrow mark A1 side relative to the through hole 24*b*1 of the cover 24, as shown in FIG. 10(*a*). Therefore, the spacer 25 rotates about the point 24*i* (which functions as rotational axis) of the cover 25 in the direction indicated by an arrow mark J. If a user wants to attach the cover 24 when the cover 24 is in the state described above, the first step to be taken by the user is to engage the anchoring portion 24*d* of the cover 24 into the cover anchoring groove 26*b* of the frame 26 as shown in FIG. 11(*b*). Then, the user is to rotate the cover 24 about the anchoring portion 24*d* in the direction indicated by an arrow mark O to finish attaching the cover 24 to the cartridge 39.

As will be evident from the above described procedure for attaching the cover 24 to the cartridge 39, the presence of the spacer 25 does not interferes with the cover attachment procedure. In this embodiment, it is recommended to engage the anchoring portion 24*d* of the cover 24 into the cover anchoring groove 26*b* of the frame 26. However, the cover 24 protects the drum 2 even if the anchoring portion 24*d* is not engaged into the cover anchoring groove 26*b* of the frame 26.

Further, even if the cover 24 is attached to the cartridge 39 as shown in FIG. 18(*b*), the cartridge 39 can still be stored in the cartridge recycle box 27. In other words, it is not mandatory for a user to engage the cover anchoring portion 24*d* of the cover 24 into the cover anchoring groove 26*b* of the frame 26 when the user attaches the cover to the cartridge 39. Further, referring to FIGS. 7(*a*) and 12(*a*), after the reattachment of the cover 24 to the cartridge 39, the cartridge 39 is the same in structure, except for the position of the spacer, as it was before the removal of the cover 24 therefrom. Therefore, the cartridge recycle box 27 may be designed to be minimum in size, that is, as small as the cartridge box for a brand-new cartridge 39, as shown in FIG. 18(*a*), in order to improve the drum cartridge 39 in terms of the efficiency with which it can be shipped to the recycling factory or the like.

Next, the operation for reattaching the cover 24 to the cartridge 39 after not only the cover 24 was removed from the cartridge 39, but also, the spacer 25 was moved relative to the cover 24 in the direction indicated by the arrow mark A2 in FIG. 12(*b*), is described. After the movement of the spacer 25 in the direction indicated by the arrow mark A2 relative to the cover 24, the spacer 25 rotates about the point 24*i* (fulcrum of cover rotation) in the direction indicated by an arrow mark N as shown in FIGS. 12(*b*) and 12(*c*), until the top surface 25*h* of the spacer 25 comes into contact with the spacer movement control wall 24*e* of the cover 24 so that the rotation of the spacer 25 in the direction indicated by the arrow mark N is stopped by the wall 24*e*. This rotation of the spacer 25 occurs because the center P of gravity of the spacer 25 is on the arrow A2 side relative to the through hole 24*b*1 of the cover 24, as shown in FIG. 12(*b*).

Figure 13:
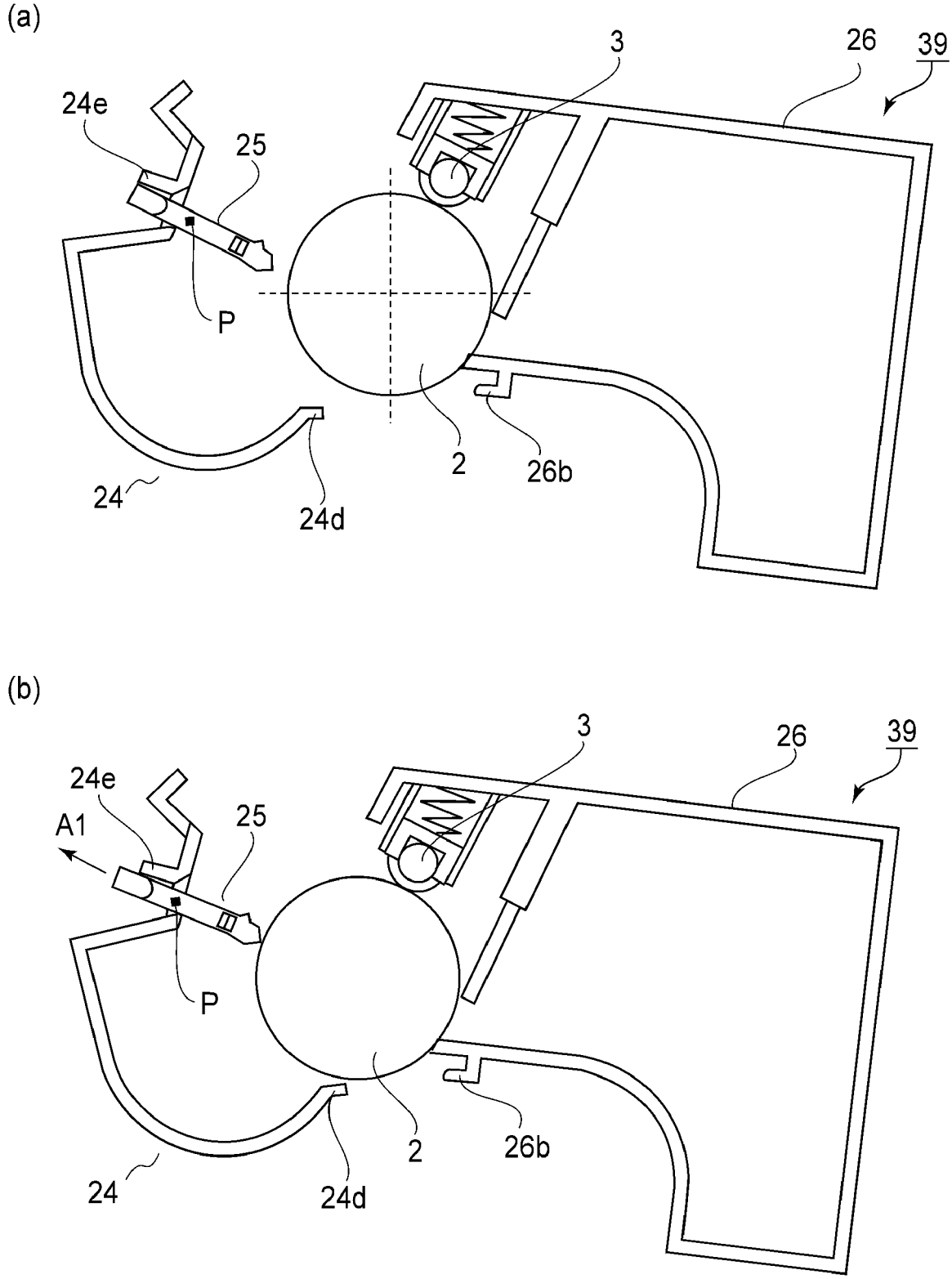
FIGS. 13(*a*) and 13(*b*) are schematic cross-sectional views of the combination of the drum cartridge, drum cover, and spacer, which are for describing the operation for attaching the drum cover to the drum cartridge.
Figure 14:
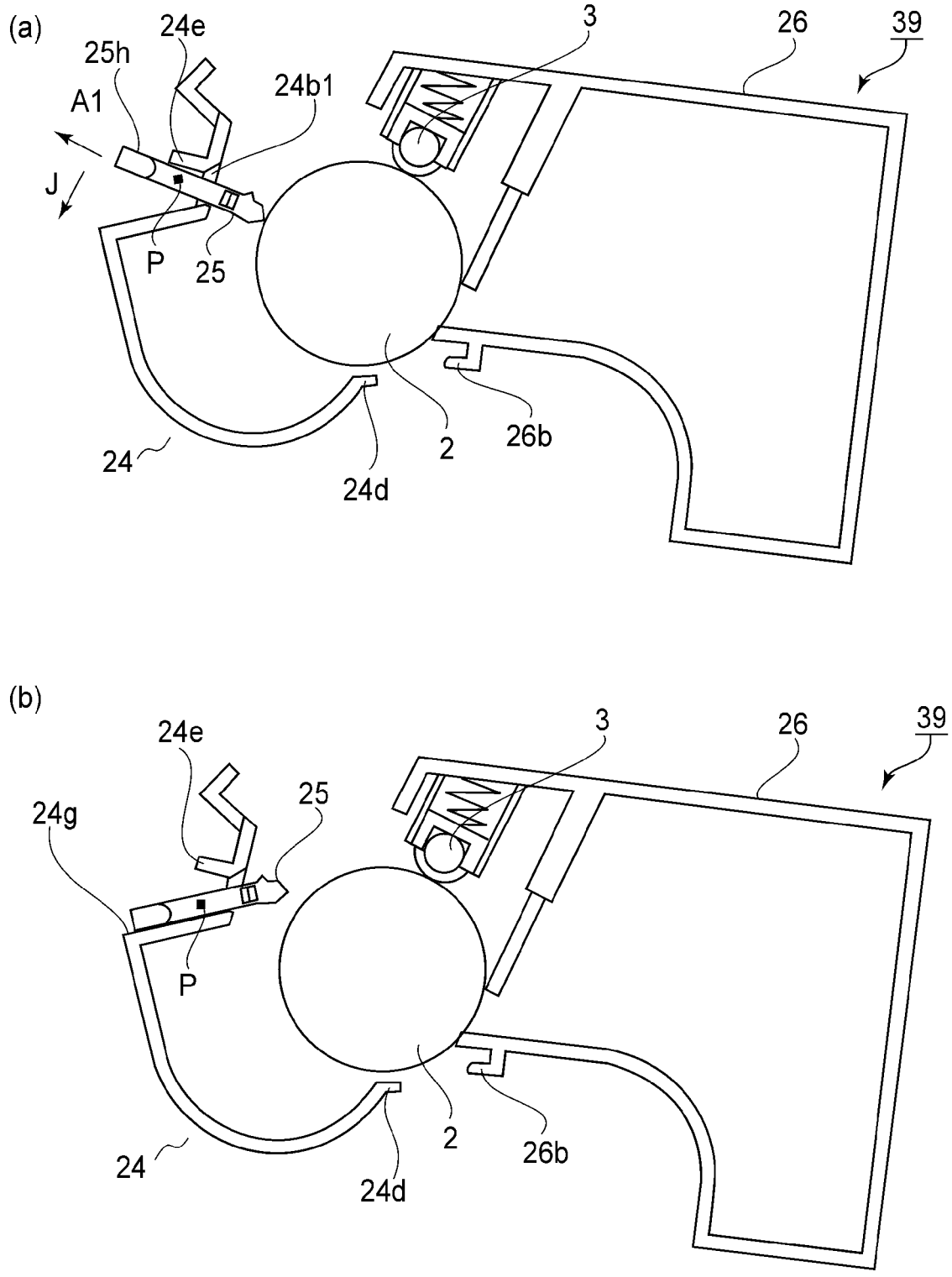
FIGS. 14(*a*) and 14(*b*) are schematic cross-sectional views of the combination of the drum cartridge, drum cover, and spacer, which are for describing the operation for attaching the drum cover to the drum cartridge.

Next, the operation for reattaching the cover 24 to the cartridge 39 when the positional relationship between the cover 24 and spacer 25 is as shown in FIG. 12(*b*) is described. Also in this case, it is recommendable to fit the cover anchoring portion 24*d* of the cover 24 into the cover anchoring groove 26*b* of the frame 26 in the same manner as in the preceding case, as shown in FIG. 11(*b*). As a user places the cover anchoring portion 24*d* near the cover anchoring groove 26*b* to fit the former into the latter, the spacer 25 comes into contact with the drum 22 as shown in FIG. 13(*b*). Thus, as the user places the cover anchoring portion 24*d* closer to the cover anchoring groove 26*b*, the spacer 25 is made to retract in the direction indicated by the arrow mark A1, as shown in FIG. 14(*b*), because the spacer 25 is attached to the cover 24 so that it is allowed to move relative to the cover 24.

Figure 15:
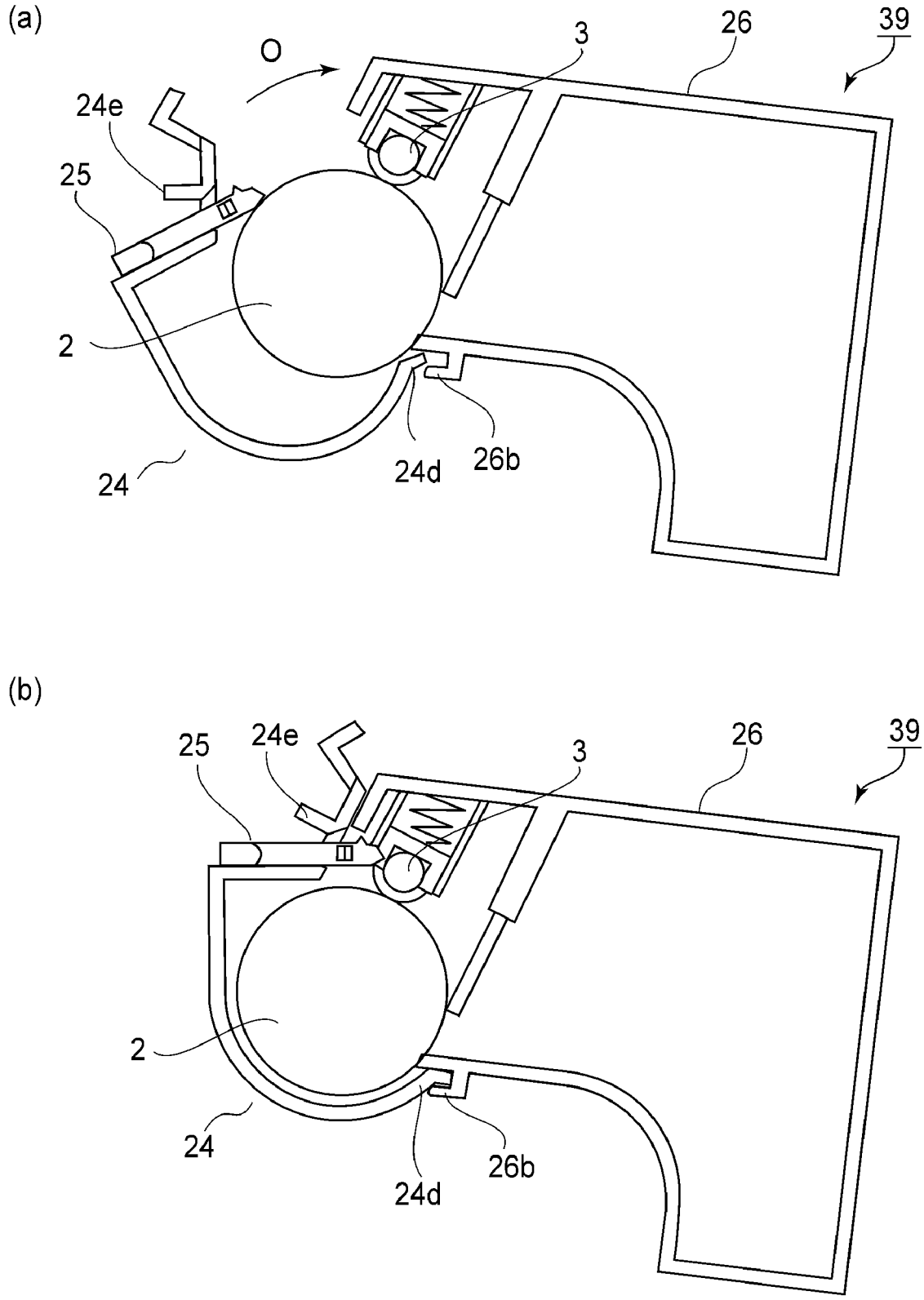
FIGS. 15(*a*) and 15(*b*) are schematic cross-sectional views of the combination of the drum cartridge, drum cover, and spacer, which are for describing the operation for attaching the drum cover to the drum cartridge.
Figure 16:
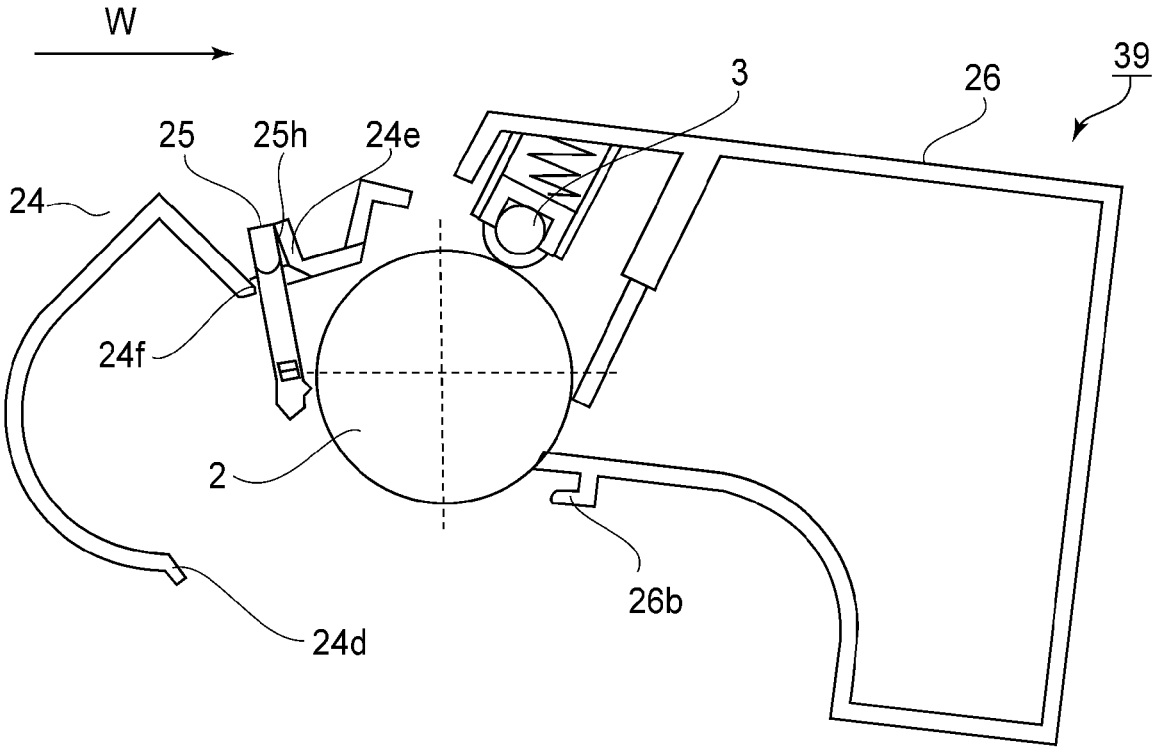
FIG. 16 is a schematic cross-sectional view of the combination of the drum cartridge, drum cover, and spacer, which is for describing the erroneous attachment of the cover to the drum cartridge.

Then, as the cover anchoring portion 24*d* is placed even closer to the cover anchoring groove 26*b*, the spacer 25 is moved in the direction indicated by the arrow mark A1 far enough for the center P of gravity of the spacer 25 to be positioned beyond the through hole 24*b* in terms of the direction indicated by the arrow mark A1. Thus, the spacer 25 rotates in the direction indicated by the arrow mark J. As a result, the bottom surface 25*g* of the spacer 25 comes into contact with the spacer movement control surface 24*g* of the cover 24 (spacer retention surface), as shown in FIG. 14(*b*), making it possible to fit the cover anchoring portion 24*d* of the cover 24 into the cover anchoring groove 26*b*, as shown in FIG. 15(*a*). Thereafter, the user is to rotate the cover 24 about the cover anchoring groove 24*d* in the direction indicated by the arrow mark O to fit the cover anchoring portion 24*d* into the cover anchoring groove 26*b*, as shown in FIGS. 15(*a*) and 15(*b*) to finish reattaching the cover 24 and spacer 25 to the cartridge 39. As is evident from the above description of the operations for reattaching the cover 24 and spacer 25 to the cartridge 39, the operation performed by the user to reattach the cover 24 and spacer 25 to the cartridge 39 is not interfered by the presence of the spacer 25, because the spacer 25 is attached to the cover 24 in such a manner that the spacer 25 is allowed to move relative to the cover 24.

In this embodiment, it is recommended to fit the cover anchoring portion 24*d* into the cover anchoring groove 26*b*. However, the cover 24 can protect the drum 2 even if its anchoring portion 24 is not fitted in the groove 26*b*. Further, the cartridge 39 can be stored in the cartridge recycle box 27 even if the cartridge 39 is refitted with the cover 24 as shown in FIG. 18(*b*). In other words, it is not mandatory that when a user reattaches the cover 24 to the cartridge 39, the user fits the cover anchoring portion 24*d* into the cover anchoring groove 26*b*. More over, after the reattachment of the cover 24 to the cartridge 39, the positional relationship between the cartridge 39 and cover 24 is the same as it was as shown in FIG. 7(*a*) before the removal of the cover 24, although the position of the spacer 25 is different as shown in FIG. 15(*b*). Therefore, the cartridge recycle box 27 may be designed to be minimum in size, that is, as small as the cartridge box for a brand-new cartridge 39, as shown in FIG. 18(*a*), in order to improve the drum cartridge 39 in terms of the efficiency with which it can be transported to the recycle factory or the like.

Further, in a case where a user wants to use a method different from the above described recommended method to reattach the cover to the cartridge 36, for example, such a method that as the user places the cover 24 close to the drum 2, the spacer 25 comes into contact with a point of the peripheral surface of the drum 2, which is below the axial line of the drum 2, the top surface 25*h* of the spacer 25 comes into contact with the spacer movement control wall 24*e*, making it impossible for the cover 24 to be placed further close to the drum cartridge 39 in the direction indicated by an arrow mark W. Therefore, the user is made to realize that the method being used for reattaching the cover is wrong.

The characteristics of the cartridge 39 in the preferred embodiment of the present invention described above can be summarized as follows: The cartridge 39 is removably mountable in the main assembly 38A of the electrophotographic image forming apparatus 38. It has: (a) rotatable image bearing member 2 on which a latent image is formed; (b) charging means 3 for charging the peripheral surface of the image bearing member 2 by being placed in contact with the peripheral surface of the image bearing member 2; and (c) frame 26 by which the image bearing member and charging means 3 are supported. It has also: (d) cover 24 removably attachable to the frame 26 to protect the peripheral surface of the image bearing member 2; and (e) spacer 25 attached to the cover 24 in such a manner that it is allowed to move relative to the cover 24. The spacer 25 has a portion which separates, and keeps separated the charging means 3 from the drum 2. The spacer 25 has the spacer disengagement preventing portions 25*c*1 and 25*c*2 which come into contact with the cover 24 to prevent the problem that when the spacer 25 is not between the image bearing member 2 and charging means 3, the spacer 25 disengages from the cover 24.

The cartridge 39 is provided with two spacers 25, which are at the lengthwise ends of the image bearing member 2, one for one, in terms of the direction parallel to the rotational axis of the image bearing member 2. The charging means 3 comprises: the rubber portion 3*a*; and the shaft 3*b* with which the rubber portion 3*a* is rotatably supported by the frame 26. The portion 25*b* of the spacer is inserted between the peripheral surface of the image bearing member 2 and the shaft 3*b* to separate, and keep separated, the charging means 3 from the image bearing member 2. The cover 24 has the holes, or grooves, 24*b*1 and 24*b*2, through which the pair of spacers 25 are put, one for one. The spacer 25 is provided with the pair of spacer insertion distance control portions 25*a*1 and 25*a*2. The control portions 25*a*1 and 25*a*2 prevent the spacer 25 from moving further in the spacer insertion direction A2 by coming into contact with the cover 24, on the upstream side of the space disengagement prevention portion 25*c*1 and 25*c*2 in terms of the direction indicated by the arrow mark A2, that is, the direction in which the charging means separating means is inserted between the image bearing member 2 and charging means 3. Also in terms of the direction, indicated by the arrow mark A2, in which the charging means separating portion 25*b* is inserted between the image bearing means 2 and charging means 3, the spacer 25 is provided with the spacer disengagement control projection 25*f* which engages with the charging means 3 to prevent the spacer 25 from easily moving in the direction indicated by the arrow mark A1, which is the opposite direction from the spacer insertion direction indicated by the arrow mark A2. The cover 24 has the spacer retaining portion 24*g* which retains the spacer 25 when the charging means separating portion 25*b* is not between the image bearing member 2 and charging means 3.

The characteristic features of the cover 24 in this embodiment can be summarized as follows: The cover 24 is one of the cartridge components, which is removably attached to the frame 26 of the cartridge 39 to protect the peripheral surface of the image bearing member 2 in the cartridge 39 which is removably mountable in the main assembly 38A of the electrophotographic image forming apparatus 38. The cartridge 39 has: the rotatable image bearing member 2 on which a latent image is formed; charging means 3 which charges the peripheral surface of the image bearing member 2 by being placed in contact with the peripheral surface of the image bearing member 2; and frame 26 by which the image bearing member 2 and charging means 3 are supported. The cover 24 has the spacer 25 attached to the cover 24 in such a manner that it is allowed to move relative to the cover 24. The spacer 25 has the charging means separating portion 25*b* which is inserted between the image bearing member 2 and charging means 3 to separate, and keep separated, the charging means 3 from the image bearing member 2. Further, the spacer 25 has the pair of spacer disengagement prevention portions 25*c*1 and 25*c*2 which come into contact with the cover 24 to prevent the spacer 25 from disengaging from the cover 24.

The cartridge 39 is provided with two spacers 25, which are at the lengthwise ends of the image bearing member 2, one for one, in terms of the direction parallel to the rotational axis of the image bearing member 2. The cover 24 has the holes, or grooves, 24*b*1 and 24*b*2, through which the pair of spacers 25 are put, one for one. The spacer 25 is provided with the pair of spacer insertion distance control portions 25*a*1 and 25*a*2. The control portions 25*a*1 and 25*a*2 prevents the spacer 25 from moving further in the spacer insertion direction A2 by coming into contact with the cover 24, on the upstream side of the space disengagement prevention portion 25*c*1 and 25*c*2 in terms of the direction indicated by the arrow mark A2, that is, the direction in which the charging means separating means is inserted between the image bearing member 2 and charging means 3. Also in terms of the direction, indicated by the arrow mark A2, in which the charging means separating portion 25*b* is inserted between the image bearing means 2 and charging means 3, the spacer 25 is provided with the spacer disengagement control projection 25*f* which engages with the charging means 3 to prevent the spacer 25 from easily moving in the direction indicated by the arrow mark A1, which is the opposite direction from the spacer insertion direction indicated by the arrow mark A2. The cover 24 has the spacer retaining portion 24*g* which retains the spacer 25 when the charging means separating portion 25*b* is not between the image bearing member 2 and charging means 3.

According to the present invention, the spacer which is inserted between the image bearing means and charging means to separate, and keep separated, the charging means from the image bearing means is in engagement with the cover in such a manner that unless a user intentionally disengages the spacer from the cover, the spacer does not disengage from the cover. Further, the spacer is in engagement with the cover in such a manner that it is allowed to move relative to the cover, the spacer does not interfere with the operation performed by the user to reattach the cover. Therefore, the cover fitted with the spacer can be easily attached to the cartridge. Thus, it is easier to protect the image bearing member when the cartridge needs to be stored outside an electrostatic image forming apparatus for a substantial length of time, or when a used-up cartridge is transported as a recyclable cartridge to a recycling station or the like. Further, the cartridge can be improved from the standpoint of reusing and/or recycling the cover and spacer.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 250059/2009 filed Oct. 30, 2009 which is hereby incorporated by reference.

What is claimed is:

1. A cartridge detachably mountable to a main assembly of an electrophotographic image forming apparatus, comprising:

(i) a rotatable image bearing member on which a latent image is to be formed;

(ii) charging means for contacting said image bearing member to charge a surface of said image bearing member;

(iii) a frame supporting said image bearing member and said charging means;

(iv) a covering member, demountably mounted to said frame, for protecting the surface of said image bearing member; and (v) a spacer member including a spacing portion, movably provided on said covering member, for entering between said image bearing member and said charging means to space them therebetween, and a retaining portion, contacting said covering member when said spacing portion is not between said image bearing member and said charging means, for preventing said spacer member from disengaging from said covering member.

2. A cartridge according to claim 1, wherein said spacer member is provided at each of one and the other ends with respect to a rotational axis direction of said image bearing member.

3. A cartridge according to claim 1, wherein said charging means includes an elastic portion and a shaft supported by said frame and rotatably supporting said elastic portion, and said spacing portion enters between the surface of said image bearing member and said shaft to space said image bearing member and said charging means from each other.

4. A cartridge according to claim 1, wherein said covering member is provided with an opening which said spacer member penetrates.

5. A cartridge according to claim 1, wherein said spacer member is provided with a regulating portion for contacting to said covering member at a position upstream of said retaining portion in an inserting direction of said spacing portion between said image bearing member and said charging means to regulate movement of said spacer member in the inserting direction.

6. A cartridge according to claim 1, wherein said spacer member is provided with a projection for engaging with said charging means at a position downstream of said spacing portion in an inserting direction of said spacing portion between said image bearing member and said charging means to regulate movement of said spacer member a direction opposite the inserting direction.

7. A cartridge according to claim 1, wherein said covering member is provided with a holding portion for holding said spacer member when said spacing portion is not between said image bearing member and said charging means.

8. A cover member usable with a cartridge, wherein the cartridge includes a rotatable image bearing member on which a latent image is to be formed; charging means for contacting said image bearing member to charge a surface of said image bearing member; a frame supporting said image bearing member and said charging means, said covering member being mountable to the frame, a covering member comprising:

a spacer member including a spacing portion, movably provided on said covering member, for entering between said image bearing member and said charging means to space them therebetween, and a retaining portion, contacting said covering member when said spacing portion is not between said image bearing member and said charging means, for preventing said spacer member from disengaging from said covering member.

9. A cover member according to claim 8, wherein said spacer member is provided at each of one and the other ends with respect to a rotational axis direction of said image bearing member.

10. A cover member to claim 8, wherein said covering member is provided with an opening which said spacer member penetrates.

11. A cover member according to claim 8, wherein said spacer member is provided with a regulating portion for contacting to said covering member at a position upstream of said retaining portion in an inserting direction of said spacing portion between said image bearing member and said charging means to regulate movement of said spacer member in the inserting direction.

12. A cover member according to claim 8, wherein said spacer member is provided with a projection for engaging with said charging means at a position downstream of said spacing portion in an inserting direction of said spacing portion between said image bearing member and said charging means to regulate movement of said spacer member a direction opposite the inserting direction.

13. A cover member according to claim 8, wherein said covering member is provided with a holding portion for holding said spacer member when said spacing portion is not between said image bearing member and said charging means.

* * * * *